United States Patent [19]

Terasaki

[11] Patent Number: 4,635,686

[45] Date of Patent: Jan. 13, 1987

[54] METHOD FOR TREATING A WEFT YARN IN A SHUTTLELESS LOOM AND DEVICE FOR EFFECTING THE SAME

[75] Inventor: Kazunori Terasaki, Kariya, Japan

[73] Assignee: Kabushiki Kaisha Toyoda Jidoshokki Seisakusho, Kariya, Japan

[21] Appl. No.: 788,217

[22] Filed: Oct. 16, 1985

[30] Foreign Application Priority Data

| | | | |
|---|---|---|---|
| Oct. 24, 1984 | [JP] | Japan | 59-223630 |
| Oct. 24, 1984 | [JP] | Japan | 59-223631 |
| Oct. 27, 1984 | [JP] | Japan | 59-226491 |
| Nov. 9, 1984 | [JP] | Japan | 59-236920 |

[51] Int. Cl.[4] ..... D03D 49/00

[52] U.S. Cl. ..... 139/116; 139/435

[58] Field of Search ..... 139/1 R, 1 C, 116, 429, 139/435

[56] References Cited

U.S. PATENT DOCUMENTS

| | | | |
|---|---|---|---|
| 3,805,850 | 4/1974 | Duynhoven et al. | 139/435 |
| 4,502,512 | 3/1985 | Suzuki et al. | 139/435 |
| 4,527,596 | 7/1985 | Kagi | 139/1 C |
| 4,529,010 | 7/1985 | Aarts | 139/429 |

*Primary Examiner*—Henry S. Jaudon

*Attorney, Agent, or Firm*—Brooks Haidt Haffner & Delahunty

[57] ABSTRACT

A method for treating a weft yarn in a shuttleless loom which has been stopped by a stopping signal.

The method comprises:

returning the loom to form an open shed so as to release a weft yarn, which has been woven in a fabric just before the stoppage of the shuttleless loom, from its condition crossed by the warp yarns;

moving a weft yarn treating device, which is normally located at a standby position located at one side of the loom, in a widthwise direction of the loom, and stopping the weft yarn treating device at a predetermined position along the width of the woven fabric;

inserting a weft yarn separating member, which is mounted on the weft yarn treating device, into the inside of the open shed from the outside of the open shed, at the predetermined position, and separating the weft yarn from the woven fabric;

repeating the moving, inserting and separating operations at a plurality of positions along the width of the woven fabric;

moving the weft yarn separating member, after repetition of the moving, inserting and separating operations, from the inside of the open shed to the outside of the open shed, while a part of the separated weft yarn is engaged with the weft yarn separating member so as to withdraw the separated weft yarn to the outside of the open shed;

holding the withdrawn weft yarn by a weft yarn holding member, which is mounted on the weft yarn treating device, at the outside of the open shed; and removing the remaining part of the weft yarn, which continues to be connected to said part of the separated weft yarn, from the inside of the open shed, by moving the weft yarn treating device.

7 Claims, 31 Drawing Figures

FIG. 4
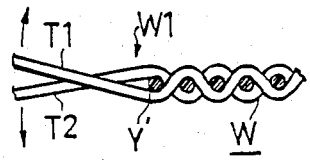
FIG. 5
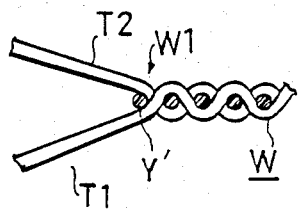
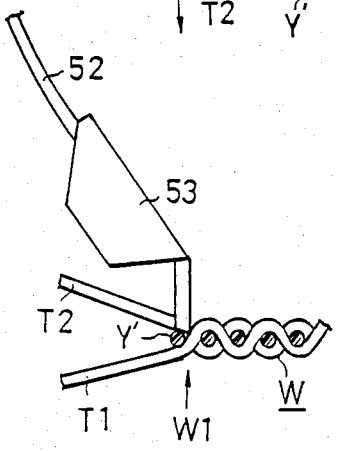
FIG. 9
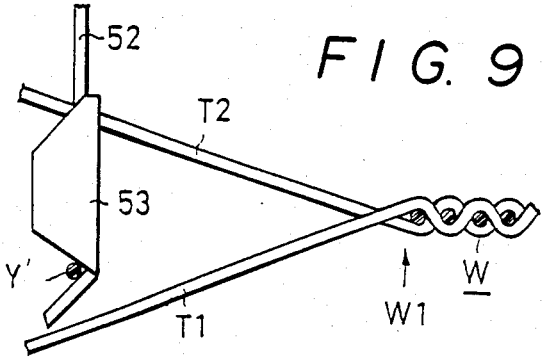
FIG. 7
FIG. 11
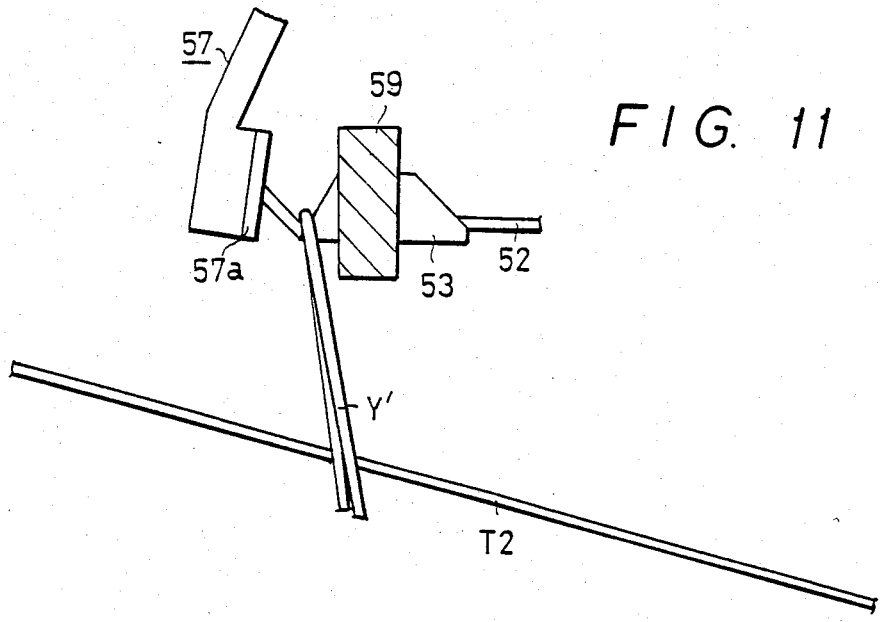

METHOD FOR TREATING A WEFT YARN IN A SHUTTLELESS LOOM AND DEVICE FOR EFFECTING THE SAME

TECHNICAL FIELD OF THE INVENTION

The present invention relates to a method for treating a weft yarn after stoppage of a shuttleless loom, such as a jet loom, a rapier loom or a gripper loom. The present invention also relates to a device for effecting the method.

PRIOR ART

Generally speaking, in a shuttleless loom, especially in a jet loom, the incidence of picking faults is higher than in a conventional shuttle weaving loom. Such stoppage of the weaving loom due to a picking fault causes a remarkable loss of production efficiency, enhancement of which is one of purposes for speeding up a weaving loom.

It should be noted that if a picking fault occurs once, the weaving loom must be stopped to repair the defected weft yarn so as to maintain the high quality of the obtained woven fabric.

Further, it should be noted that the operating timing of a high speed shuttleless weaving loom is selected in such a manner that, even if its driving system is switched off just after a picking fault is detected, the weaving loom does not stop until after about one cycle operation, due to inertial force, from the detection of the picking fault in order to avoid damage of parts of the shuttleless weaving loom by excessive deceleration. As a result, in a conventional shuttleless weaving loom, when the shuttleless weaving loom is switched off upon detection of a picking fault, the succeeding picking cycle takes place before stoppage of the loom. Therefore, it is necessary to remove not only the weft yarn which caused the picking fault but also the weft yarn which was picked in the succeeding cycle by returning the loom in a reverse direction. Conventionally, the removal of such defective weft yarns has been manually performed.

However, in this case, since the weft yarn which was picked in the cycle just after the picking fault has already been subjected to the usual beating operation, and it is securely held by the woven fabric, its removal is not easy even if the upper and lower warp yarns are open to the utmost limit, and therefore, the removing operation is very troublesome. As a result, the period of suspension of the weaving loom becomes long, and a loss of production efficiency of the weaving loom occurs.

U.S. Pat. No. 4,503,889 discloses an example of a weft yarn treating method and device for avoiding such disadvantages.

In this conventional device, as illustrated in the attached FIG. 19, a main frame 1 is hung from and movable along a guide rail (not shown), which is disposed in a widthwise direction of a woven fabric, and the main frame 1 has a first pneumatic cylinder 2 mounted therein, a piston rod 2*a* of which is connected to an auxiliary frame 3. The auxiliary frame 3 has a second pneumatic cylinder 4 mounted therein, a piston rod 4*a* of which is connected to a third pneumatic cylinder 5. A supporting surface 6 is fixed to the third pneumatic cylinder 5, and a clamping surface 7 is fixed to the piston rod 5*a*, so that a weft thread to be removed can be caught by the surfaces 6 and 7. A pair of take up rollers 8 and 9 are disposed at the lower portion of the auxiliary frame 3. One of the take up rollers 9 is swingably supported on a lever and is urged to the other take up roller 8 by means of a tension spring (not numbered). A resilient finger 10 is so disposed beneath the take up rollers 8 and 9 that its free end can move along a closed path in a shape of a relatively flat ellipse. A suction mouth 11 is disposed adjacent to the position where the elevated clamping surfaces 6 and 7 located.

When a weft yarn (not shown) woven in a woven fabric W is required to be separated from the woven fabric W, the second pneumatic cylinder 4 is actuated to lower the supporting surface 6 and the clamping surface 7, until the supporting surface 6 and the clamping surface 7 are inserted into the open shed formed by the upper and lower warps T as illustrated in a two-dot-and-one-dash line while the take up roller 9 is displaced downwardly. Further, the finger 10 is moved from the outside of the open shed to the inside of the open shed, and it catches the weft yarn. Thus, the weft yarn is separated from the woven fabric W and is moved to a position between the supporting surface 6 and the clamping surface 7. Then, the third pneumatic cylinder 5 is actuated, and the weft yarn is caught by the supporting surface 6 and the clamping surface 7. Thereafter, the second pneumatic cylinder 4 is actuated to lift both the supporting surface 6 and the clamping surface 7, and the weft yarn is pulled out from the open shed. Then the take up rollers 8 and 9 are driven, and the weft yarn is entirely withdrawn. The weft yarn thus withdrawn is sucked by the suction mouth 11 disposed on the auxiliary frame 3.

In the weft yarn treating method utilizing this conventional device, if a weft yarn is broken and a part of the defected weft yarn reaches a suction mouth (not shown) disposed at the receiving side of the weaving loom near the cloth fell, the part is separated from the cloth by means of the finger 10 and is sucked by the suction mouth from the open shed. However, removal of such a weft yarn from the open shed by suction force is uncertain, because the broken weft yarn may easily make contacts with the warps.

Further, in the conventional method, defective weft yarn, which remains in the cloth, is separated from the cloth at the receiving side and is removed there. As a result, only a part of the weft yarn located near the receiving side is loosened and the remaining part is not loosened. Therefore, it is very difficult to entirely remove a defective weft yarn. Thus, such a defective weft yarn may often be broken during the removing operation.

Still further, in the conventional method, a defective weft yarn is upwardly withdrawn through a small gap between warps. Accordingly, the warps located at the position where the weft yarn is withdrawn, may be abraded by the withdrawn weft yarn and may be changed. In addition, the weft yarn may not be smoothly withdrawn, due to abrasion, and may be broken during the removal operation. Such a broken weft yarn is often included in the woven fabric after the weaving loom is restarted.

In addition, since both the supporting surface 6 and the clamping surface 7 for catching a weft yarn separated from the woven fabric W are inserted into the open shed in this conventional device, the incidence of warp yarn damage increases by the insertion of such a supporting surface 6 or such a clamping surface 7 into the open shed through a gap between warps or by the retraction of such supporting surface 6 or clamping surface 7 from the open shed through the gap between warps. As a result, warp yarn breakage may occur easily. Especially, when the supporting surface 6 and the clamping surface 7 are moved upwardly from the inside of the open shed to the outside of the open shed, an upper warp T may be easily picked up by them. Thus, there is a problem that the defective weft cannot be surely removed without causing any warp yarn damage.

Further, it is very difficult to set the timing for catching a weft yarn by the supporting surface 6 and the clamping surface 7, because the supporting surface 6 and the clamping surface 7 receive the weft yarn separated from the woven fabric W from the finger 10 in a narrow space within the open shed while the free end of the finger 10 is moved along an elliptical path.

OBJECT OF THE INVENTION

An object of the present invention is to provide a method by which a faultily picked weft yarn, upon the stoppage of a shuttleless loom, can be readily and automatically removed from the woven fabric without troublesome manual operations and without causing any damage to the warp yarns.

Another object of the present invention is to provide a device suitable for effecting the method.

SUMMARY OF THE INVENTION

According to the present invention, a method for treating a weft yarn in a shuttleless loom is provided. The method comprises:

returning the shuttleless loom to form an open shed so as to release a weft yarn, which has been woven into the fabric just before the stoppage of the shuttleless loom, from its woven condition between the crossed warp yarns;

moving a weft yarn treating device, which is normally located at a standby position located at one side of the loom, in a widthwise direction of the shuttleless loom, and stopping the weft yarn treating device at a predetermined position along the width of the woven fabric;

inserting a weft yarn separating member, which is mounted on the weft yarn treating device, into the inside of the open shed from the outside of the open shed, at the predetermined position, and separating the weft yarn from the woven fabric;

repeating the moving, inserting and separating operations at a plurality of positions along the width of the woven fabric;

moving the weft yarn separating member, after repetition of the moving, inserting and separating operations, from the inside of the open shed to the outside of the open shed, while a part of the separated weft yarn is engaged with the weft yarn separating member so as to withdraw the separated weft yarn to the outside of the open shed;

holding the withdrawn weft yarn by a weft yarn holding means, which is mounted on the weft yarn treating device, at the outside of the open shed; and removing the remaining part of the weft yarn, which continues to be connected to the part of the separated weft yarn held by the weft yarn holding means, from the inside of the open shed, by a weft yarn removing means.

Further, according to the present invention, a device for treating a weft yarn in a shuttleless loom is provided. The device comprises:

a weft yarn separating means for inserting a weft yarn separating member from the outside of an open shed into the inside of the open shed so as to separate the weft yarn under the open shed condition wherein a weft yarn, which has been picked just before the stoppage of the shuttleless loom, is released from its woven condition between the crossed warp yarns;

a weft yarn withdrawing means for moving the weft yarn separating member from the inside of the open shed to the outside of the open shed so as to withdraw a part of the weft yarn to the outside of the open shed;

a weft yarn holding means for holding the part of weft yarn which has been withdrawn to the outside of the open shed; and a weft yarn removing means for further removing the remaining weft yarn continuing to be connected to the part of weft yarn held by the holding means.

More specifically, according to the present invention, a weft yarn separating member is moved from a position near the woven fabric towards a position near the reed so as to be entered into the inside of the open shed from the outside of the open shed under an open shed condition wherein a weft yarn, which has been picked just before the stoppage of the shuttleless loom, is released from its condition crossed by the warp yarns. At this time, the weft yarn separating member moves across the cloth fell and separates the fautilty picked weft yarn from the woven fabric. Such a separating operation is repeated at a plurality of positions along the width of the woven fabric so that the faulty weft yarn is separated from the woven fabric for a certain length along the width of the woven fabric. The weft yarn separating member is moved from the inside of the open shed to the outside of the open shed while a part of the faulty weft yarn is engaged by the weft yarn separating member. The part of the faulty weft yarn which has been withdrawn to the outside of the open shed is held by the weft yarn holding means, which has been waiting at the outside of the open shed. The remaining part of the faulty yarn, which continues to be connected to the part held by the holding means, is removed from the inside of the open shed, for example, by moving the entire device in the width direction of the woven fabric.

The weft yarn separating member may be moved to withdraw the weft yarn from the inside of the open shed to the outside of the open shed after the last separating operation. In this case, the faulty weft yarn is entirely removed at one time.

The weft yarn may be withdrawn a plurality of times, for example, twice, after a part of the weft yarn is separated from the woven fabric.

Since only the weft yarn separating member is inserted into the inside of the open shed during the above-described weft yarn treating operation, the incidence of warp damage can be remarkably minimized. Further, since the faulty weft yarn, which has been removed from the woven fabric, is transferred to and held by the holding means at the outside of the open shed after it is withdrawn to the outside of the open shed, the setting of the timing for transferring the faulty weft yarn and for holding the latter can be easier compared to the conventional method wherein the faulty weft yarn is held in an insufficient space within the open shed. Thus, the faulty weft yarn can be surely removed.

BRIEF DESCRIPTION OF THE DRAWINGS

The present invention will now be explained in detail with reference to the accompanying drawings, wherein:

FIG. 4 is an enlarged cross sectional view showing the condition wherein a faultily picked yarn is woven within the woven fabric;

FIG. 5 is an enlarged cross sectional view showing the condition wherein the faulty yarn is released from its condition crossed by the warp yarns;

FIG. 7 is sa cross sectional view showing the condition around the cloth fell, wherein some parts are omitted;

FIG. 9 is an enlarged sectional side view of the weft yarn separating member which has been operated from the condition shown in FIG. 7;

FIG. 11 is an enlarged sectional side view of a part of the weft yarn treating device which has been operated from the condition shown in FIG. 9;

DETAILED DESCRIPTION OF THE INVENTION

In the first embodiment illustrated in FIGS. 1 through 13, the method of the present invention is performed follows.

First, the shuttleless loom is returned to form an open shed so as to release a weft yarn, which has been woven into the fabric just before the stoppage of the shuttleless loom, from its condition crossed by the warp yarns. Then, a weft yarn treating device, which is normally located at a standby position located at one side of the loom, is moved in a widthwise direction of the shuttleless loom toward the opposite side, and the weft yarn treating device is stopped at a predetermined position. A weft yarn separating member, which is mounted on the weft yarn treating device, is inserted into the inside of the open shed from the outside of the open shed, at the predetermined position, and the weft yarn is separated from the woven fabric. The moving, inserting and separating operations are repeated at a plurality of positions along the width of the woven fabric. At the last position, the weft yarn separating member is moved from the inside of the open shed to the outside of the open shed, while a part of the separated weft yarn is engaged by the weft yarn separating member so as to withdraw the separated weft yarn to the outside of the open shed. The withdrawn weft yarn is then held by a weft yarn holding means, which is mounted on the weft yarn treating device, at the outside of the open shed. Then, the weft yarn treating device is returned to the standby position, and the remaining part of the weft yarn, which continues to the part of the separated weft yarn held by the holding means, from the inside of the open shed, is withdrawn as the weft treating device is moved to the standby position.

Figure 1:
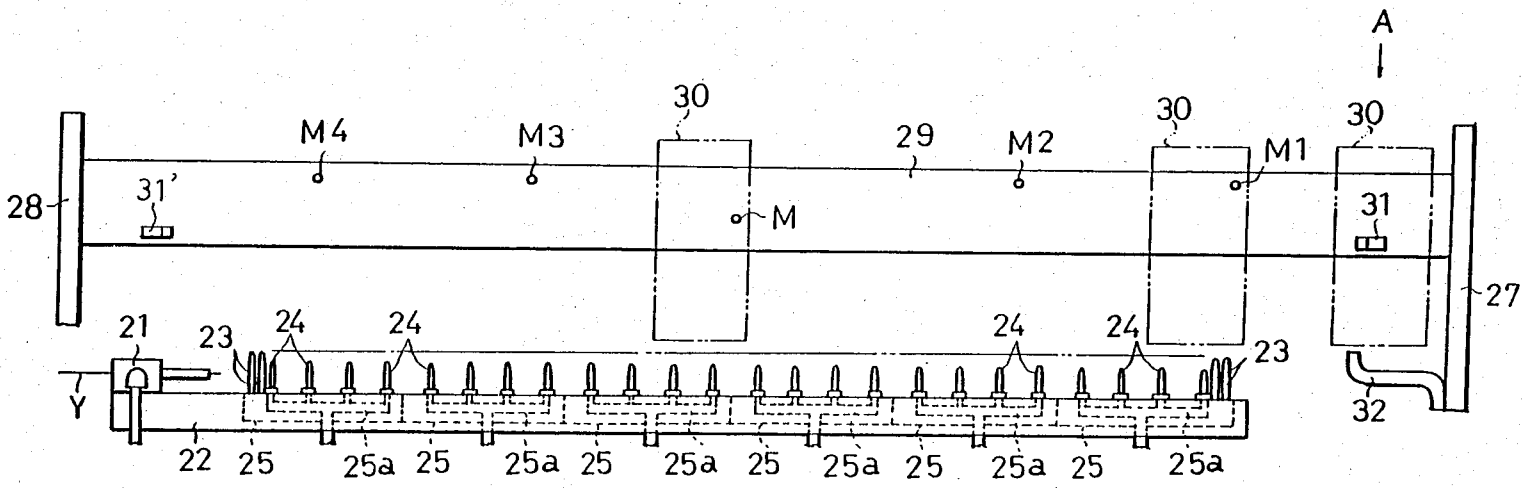
FIG. 1 is a schematic elevation view of a slay and a guide rail of an embodiment of the device according to the present invention.

In FIG. 1, a main nozzle 21 is disposed at one end of a slay 22. A weft yarn Y is guided to the main nozzle 21 through a weft measuring mechanism and a weft storage mechanism (not shown) and is inserted by jet of fluid ejected from the main nozzle 21, into a weft guide passage S (FIG. 3) formed by a plurality of weft guides 23 (only a few of which are shown in FIG. 1) disposed on and along the slay 22. The weft yarn Y, which has been inserted into the weft guide passage S, is assisted by auxiliary fluid jets ejected from a plurality of auxiliary nozzles 24 disposed along and between the weft guides 23 at predetermined spacing distances, as well known.

The predetermined number of weft guides 23 and auxiliary nozzles 24 are disposed on a block 25, and a plurality of (six in the illustrated embodiment) blocks 25 are attached in aligned relation. The auxiliary nozzles 24 of each block 25 are connected to a fluid supply (not shown) through fluid passages 25*a* formed in the block 25. Thus, the auxiliary nozzles 24 on the same block 25 eject auxiliary jet fluid toward the side opposite to the main nozzle 21 in synchronism with the picking timing of the weft yarn Y ejected from the main nozzle 21, so that the front portion of the weft yarn Y is successively urged along within the guide channels, from the main nozzle 21 to the side opposite the main nozzle 21.

Figure 3:
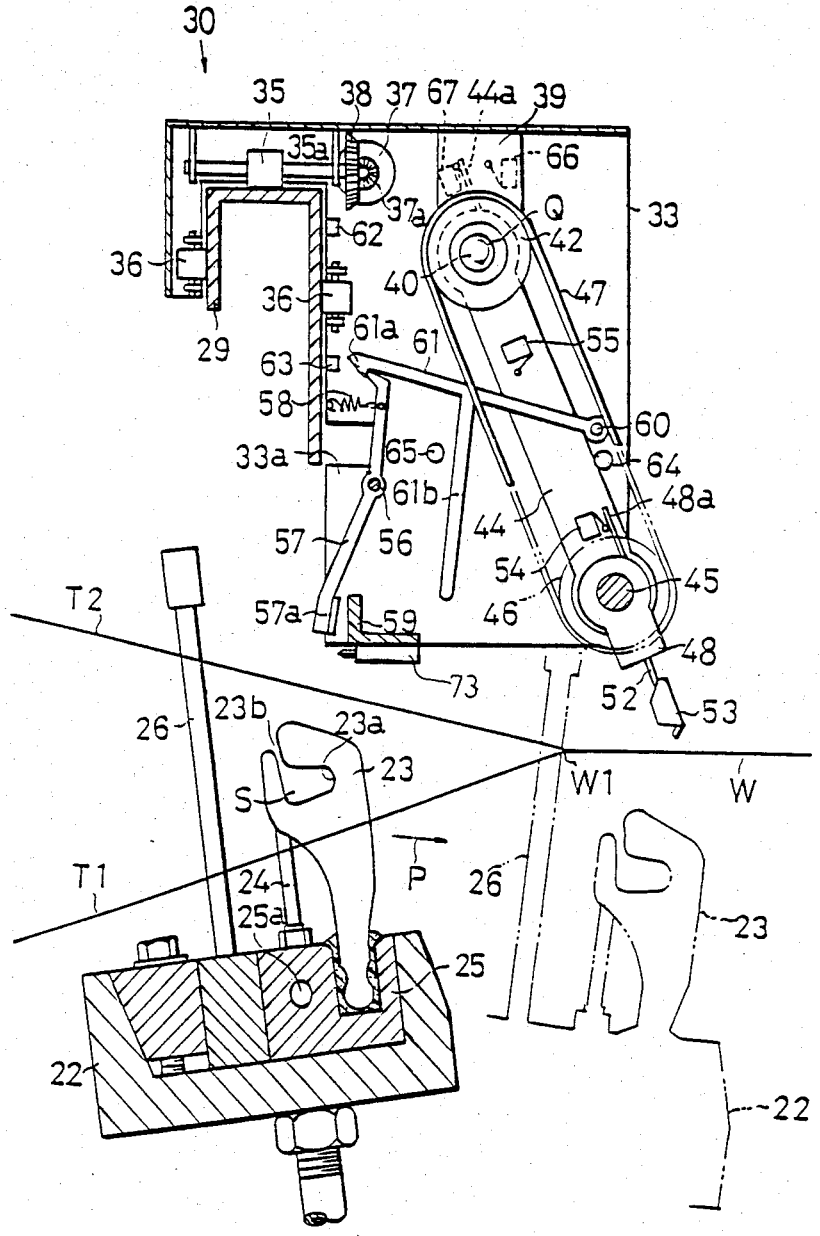
FIG. 3 is a sectional side view of the weft yarn treating device illustrated in FIG. 2 and the slay.

When the weft yarn Y ejected from the main nozzle 21 is properly inserted and reaches the side of the woven fabric W opposite to the main nozzle 21, the weft yarn Y escapes from the guide hole 23*a* of the weft guides 23 through the slit 23*b* as the slay 22 moves forwardly as illustrated by arrow P in FIG. 3. Then, the weft yarn Y is beaten to the woven fabric W by a reed 26 and forms new cloth fell W1, and the rear end of the weft yarn Y extending from the main nozzle 21 is cut by a cutter (not shown) disposed at a position adjacent to the side of the woven fabric W near the main nozzle 21. Thereafter, the weaving operation is repeated.

When a picking fault occurs, for example, a fault wherein the weft yarn Y ejected from the main nozzle 21 does not reach the side of the woven fabric W opposite to the main nozzle 21, the fault is detected by a sensor (not shown) disposed in or some of the weft guides 23 at a position adjacent from the side of the woven fabric W opposite to the main nozzle 21. Based on the faulty picking signal emitted by the sensor, the motor for driving the weaving loom is switched off. The sensor is of a conventional photo electric type comprising a paired photo emitter and receiver facing each other and sandwiching the slit 23*b* of the weft guides 23 therebetween, which emits a faulty picking signal if it does not detect the weft yarn Y in the slit 23*b* upon the beating up operation.

The weaving loom continues its operation, due to inertial force, until it rotates about one cycle and a half after emission of the faulty picking signal, which also serves as a signal for stopping the weaving loom. More specifically, when the faulty picking occurs, the faulty picking signal is emitted while the reed 26 moves forwardly in a direction designated by arrow P from the fully retracted position illustrated in a solid line in FIG. 3. However, the weaving loom does not come to a standstill until the reed 26 beats the faulty weft yarn and returns to its fully retracted position and thereafter reaches a position just before the beating up operation. Accordingly, the faulty weft yarn Y' is woven into the woven fabric W as illustrated in FIG. 4. The picking operation continues during the rotation of the weaving loom by inertial force. Although a weft yarn following the faulty weft yarn Y' is ejected from the main nozzle 21, the ejected weft yarn Y is prevented from being picked by means of an insertion preventing mechanism (not shown) of a conventionally known type disposed at a position adjacent to the main nozzle 21.

In FIG. 1, support frames 27 and 28 are disposed on the side frames (not shown) located at the right and left sides of the weaving loom. A guide rail 29 connects the support frames 27 and 28 over the slay 22. The guide rail 29 has a weft treating device 30 of the present invention movably mounted thereon. The weft treating device 30 is normally positioned at a standby position designated by arrow A in FIG. 1 and located away from the main nozzle 21.

The guide rail 29 has engaging projections 31 and 31' fixed on the front surface thereof, each formed in a wedge shape as illustrated in FIGS. 13*a* through 13*f*. The engaging projection 31 is disposed at a position opposite the main nozzle 21, and the engaging projection 31' is disposed at a position near the main nozzle 21. In some cases, the engaging projection 31' may be omitted.

A suction pipe 32 is disposed at the inside of the support frame 27 and the free end of the suction pipe 32 extends to the lower side of the weft yarn treating device 30.

Figure 2:
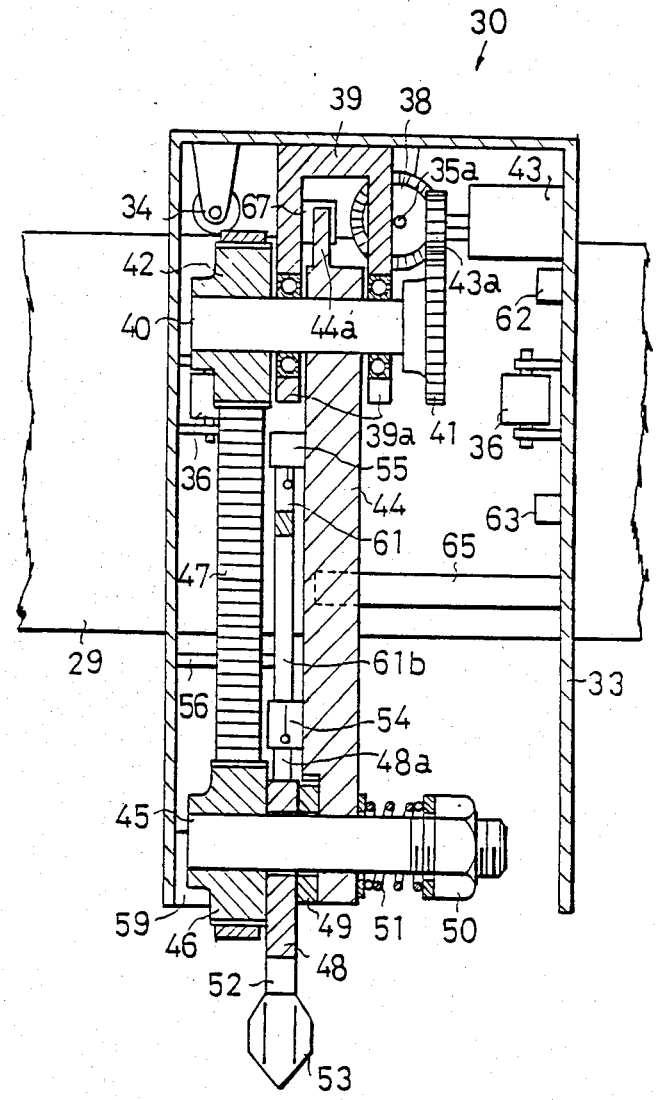
FIG. 2 is a sectional elevation view of a weft yarn treating device of the present invention.

As illustrated in FIGS. 2 and 3, the weft yarn treating device 30 is movably supported on the guide rail 29 by means of a guide roller 34 and a drive roller 35 disposed on the inner surface of the upper wall of the frame 33 and is laterally positioned by means of a plurality of guide rollers 36 disposed on the inner surface of the side wall of the frame 33. In FIG. 3, a reversible drive motor 37 is disposed on the side wall of the frame 33 near the drive roller 35, and a drive bevel gear 37*a*, fixed on the output shaft of the reversible drive motor 37, meshes with a bevel gear 38 fixed on the shaft 35*a* of the drive roller 35. Accordingly, the weft yarn treating device 30 is moved to the right or to the left along the guide rail 29 as the reversible drive motor 37 is forwardly or backwardly.

A support bracket 39 extends downwardly from the inner surface of the upper wall of the frame 33 in front, i.e., at the right side in FIG. 3, of the guide rail 29 and has a swing shaft 40 swingably mounted thereon. In FIG. 2, the swing shaft 40 has a gear 41 fixed at the right side thereof and a timing pulley 42 fixed at the left side thereof. A reversible motor 43 is disposed on the inner surface of the side wall of the frame 33 at a position near the gear 41 and has a drive gear 43*a* fixed to the output shaft thereof, which gear meshes with the gear 41.

In FIG. 2, the swing shaft 40 has a swing arm 44 extending downwardly therefrom. The swing arm 44 is located at a position between the support pieces 39*a* of the support bracket 39, which is formed in a U-shape. The swing arm 44 has a lower shaft 45 rotatably mounted at the lower end thereof. As clearly shown in FIGS. 2 and 3, limiting rods 64 and 65 project from the right wall (in FIG. 2) of the frame 33 to limit the range wherein the swing arm 44 can swing.

In FIG. 2, lower shaft 45 has a timing pulley 46 fixed at the left end thereof. A timing belt 47 formed in a loop engages the timing pulley 46 and timing pulley 42. A weft yarn separating arm 48 is fixed to the side of the timing pulley 46 so that the weft yarn separating arm 48 is located at a position between the timing pulley 46 and the swing arm 44. The swing arm 44 has a brake lining 49 attached to the side surface thereof facing the timing pulley 46. The weft yarn separating arm 48 can be swung relative to the lower shaft 45. A nut 50 is screwed onto the right side of the lower shaft 45, and a compression spring 51 is inserted between the nut 50 and the swing arm 44. Thus, the swing arm 44 is urged against the brake lining 49 by means of the nut 50 and the compression spring 51.

The weft yarn separating arm 48 has a weft yarn separating member 53 at the front end thereof via leaf spring 52. A limit switch 54 is disposed on the side surface of the swing arm 44 at a position near the base portion of the weft yarn separating arm 48, and the limit switch 54 is normally turned on by means of a dog 48*a* projecting from the base portion of the weft yarn separating arm 48. A limit switch 55 is disposed on the side surface of the base portion of the swing arm 44 and emits a signal for driving the reversible motor 43 in a backward direction.

Limit switches 66 and 67 are disposed at a position between the support pieces 39*a* of the support bracket 39 and are actuated by the dog 44*a* projecting upwardly from the base portion of the swing arm 44.

A support shaft 56 projects from the side wall of the frame 33 at a position near the guide rail 29 and has a weft yarn holding lever 57 swingably mounted thereon. The weft yarn holding lever 57 is normally urged in a counterclockwise direction in FIG. 3 by means of a tension spring 58, which is disposed between the upper portion of the weft yarn holding lever 57 and the frame 33. A holding member 57*a* is formed at the lower end of the weft yarn holding lever 57 and can abut against the stop member 59 formed at the lower portion of the left side wall of the frame 33.

A cavity 33*a* is formed on the side wall of the frame 33 so as to permit the engaging projection 31 to pass through while the weft yarn treating device 30 moves to and from the standby position A. When the weft yarn treating device 30 is located at the standby position A, the engaging projection 31 swings the weft yarn holding lever 57 in such a direction that the holding member 57*a* moves away from the stop member 59.

A supporting arm 60 projects from the right side wall of the frame 31 and has an engaging lever 61 swingably supported thereon in such a manner that the engaging lever 61 extend between the swing arm 44 and the timing belt 47. The engaging lever 61 is formed in a T shape, the hook portion 61*a* of which can be engaged with the upper portion of the weft yarn holding lever 57, and lower end of the hanging portion 61*b*, extending downwardly from the center of which, can abut on the weft yarn separating arm 48. Further, the upper portion of the engaging lever 61 can abut on the limit switch 55 to actuate the latter.

In FIG. 2, proximity switches 62 and 63 are disposed on the right side wall at positions adjacent to the guide rail 29 and spaced vertically against. The upper proximity switch 62 corresponds to the magnets M1, M2, M3 and M4 fixed on the front surface of the guide rail 29 in FIG. 1, and the lower proximity switch 63 corresponds to the magnet M in FIG. 1. When the proximity switches 62 and 63 are actuated, the reversible drive motor 37 is stopped and the reversible motor 43 is operated. In this embodiment, the proximity switches 62 and 63 are so constructed that, when the weft yarn treating device 30 is moving to the left along the guide rail 29, i.e., when the reversible drive motor 37 is rotated forwardly, the proximity switch 62 is operated, and when the weft yarn treating device 30 is moving to the right along the guide rail 29, i.e., when the reversible drive motor 37 is rotated backwardly, the proximity switch 63 is operated. When the proximity switch 63 is actuated, the limit switches 66 and 67 are deenergized so that the reversible motor 43 is not stopped by the limit switches 66 and 67.

In this embodiment, when a picking fault occurs, the faulty weft yarn is automatically treated in accordance with a predetermined weft yarn treating program.

The weft yarn treating operation upon occurrence of a picking fault will now be explained with reference to FIGS. 13*a* through 13*f*.

When the picking fault occurs, as described above, the faulty weft yarn Y′ is woven in the woven fabric W as illustrated in FIG. 4 and the picking of the weft yarn ejected after the faulty weft yarn Y′ is prevented by the signal for stopping the operation of the weaving loom.

The weaving loom is automatically reversed for about one cycle and a half after the weaving loom comes to a stand still, and thus, the reed 26 stops at the most retracted position designated by a solid line in FIG. 3. As the reverse operation of the weaving loom starts, the warp yarns T1 and T2 are moved vertically in directions designated by arrows in FIG. 4, respectively. When the weaving loom is stopped after reverse operation, the warp yarns T1 and T2 come to their utmost open shed condition as illustrated in FIG. 5. Accordingly, the faulty weft yarn Y′ (which is designated by Y1 in FIGS. 13*a* through 13*f*) is released from the condition wherein it is held by the warp yarns T1 and T2, i.e., a woven condition.

Figure 13A:
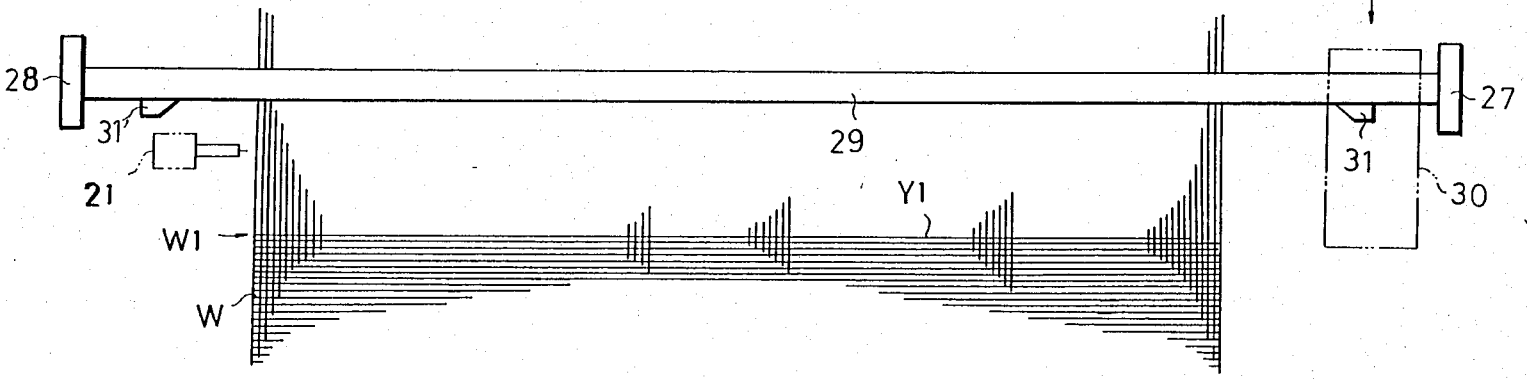
FIG. 13*a* through 13*f* are plan views illustrating a first method for treating a weft yarn in accordance with the present invention.
Figure 13B:
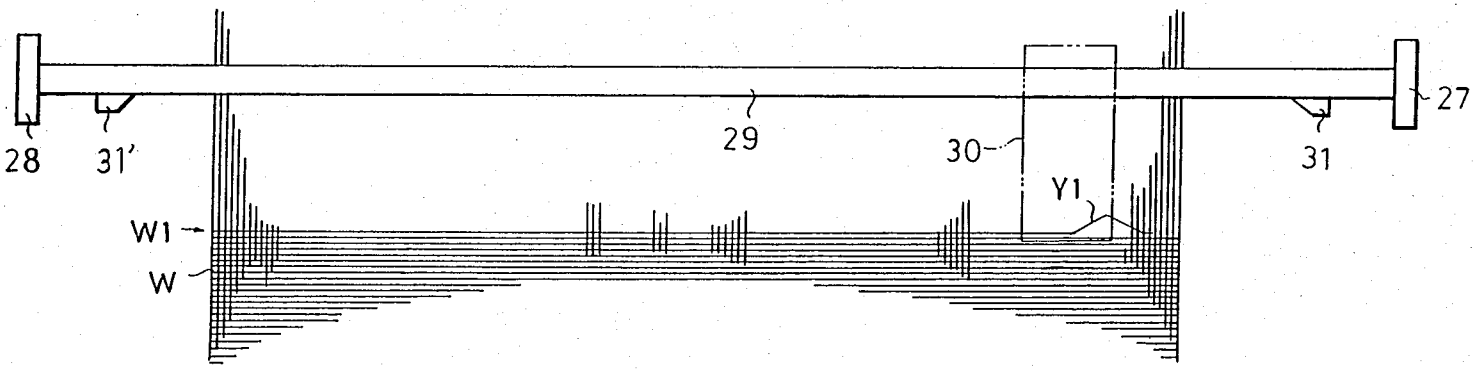
Figure 13C:
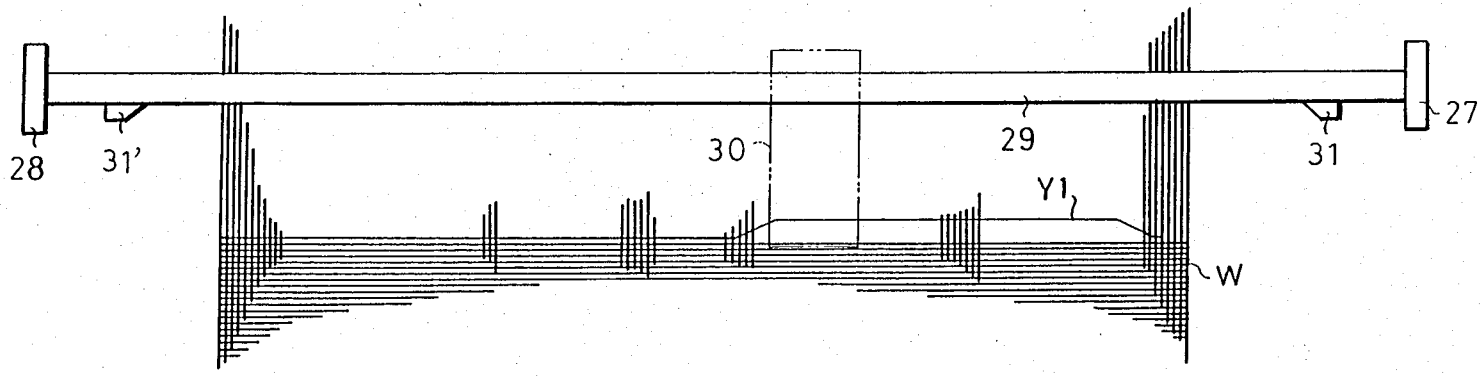

After the reverse operation of the weaving loom, the reversible drive motor 37 is moved forwardly, and the weft yarn treating device 30, which has been at the standby position A as illustrated in FIG. 13*a*, moves toward the main nozzle 21 along the guide rail 29. When the proximity switch 62 faces the magnet M1 (FIG. 1), the operation of the reversible drive motor 37 is stopped and the weft yarn treating device 30 stops. As soon as the weft yarn treating device 30 stops, the reversible motor 43 is moved forwardly. As a result, the swing shaft 40 is rotated in a direction designated by arrow Q in FIG. 3. The rotation of the swing shaft 40 is transmitted to the lower shaft 45 via the timing belt 47, and the lower shaft 45 is rotated in the same direction as that of the swing shaft 40. In this case, since the weft yarn separating arm 48 fixed to the timing pulley 46 is urged against the swing arm 44 via the brake lining 49, there is a sufficient frictional torque between the swing arm 44 and the weft yarn separating arm 48 to prevent a relative rotation therebetween. Accordingly, swing arm 44 and weft yarn separating arm 48 are swung in unison in a clockwise direction in FIG. 3.

Figure 6:
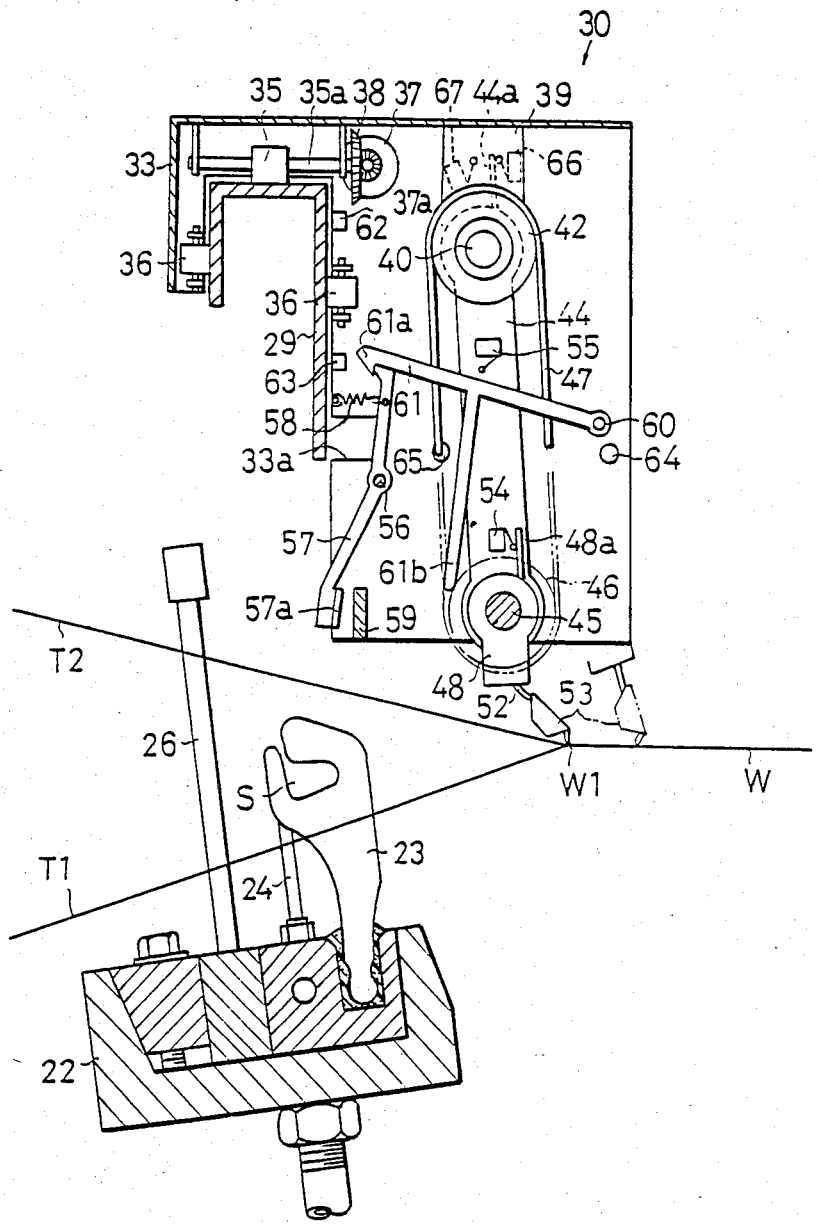
FIG. 6 is a sectional side view of the weft yarn treating device which has been operated from the condition shown in FIG. 3, wherein some parts are omitted.

As the swing arm 44 and weft yarn separating arm 48 are rotated, the lower end of the weft yarn separating member 53 slides over the woven fabric W toward the cloth fell W1 as illustrated in FIG. 6. When the lower end of the weft yarn separating member 53 reaches the cloth fell W1 as illustrated in FIGS. 6 and 7, the front end of the weft yarn separating member 53 engages with the faulty weft yarn Y′. Thus, the faulty weft yarn Y′ (Y1 in FIG. 13*b*) in the vicinity of the weft yarn treating device 30 is separated from woven fabric W by means of the weft yarn separating member 53 which is inserted from the outside of the open shed into the inside of the open shed.

As soon as the swing arm 44 abuts the limiting rod 65, the limit switch 66 is actuated by means of the dog 44*a*, and then, the reversible motor 43 is moved backwardly. Accordingly, the swing arm 44 is returned from the condition illustrated in FIG. 8 to that illustrated in FIG. 3, and is limited in its swinging motion by the limiting rod 64. Then, the limit switch 67 is actuated by means of the dog 44*a*, and the reversible motor 43 is stopped and the reversible drive motor 37 is moved forwardly. Thus, the weft yarn treating device 30 is moved toward the main nozzle 21 along the guide rail 29, and weft yarn separating operations similar to that described above are repeated at positions corresponding to the magnets M2, M3 and M4 (see FIGS. 13*c* and 13*d*), skipping the center position M because the proximity switch 62 is not actuated thereby.

After the completion of the weft yarn separating operation at the position corresponding to the magnet M4, the weft yarn treating device 30 is operated as follows.

Figure 13D:
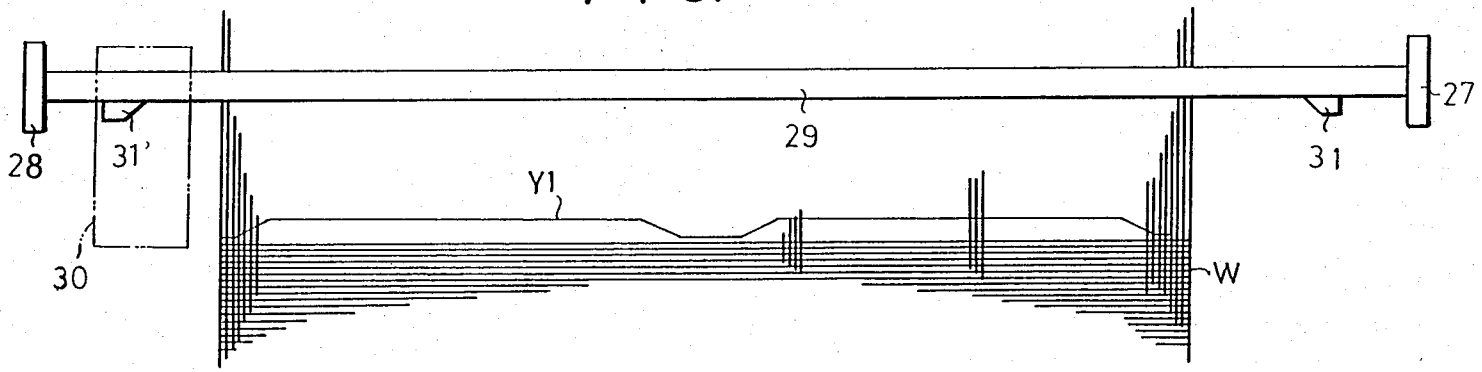
Figure 13E:
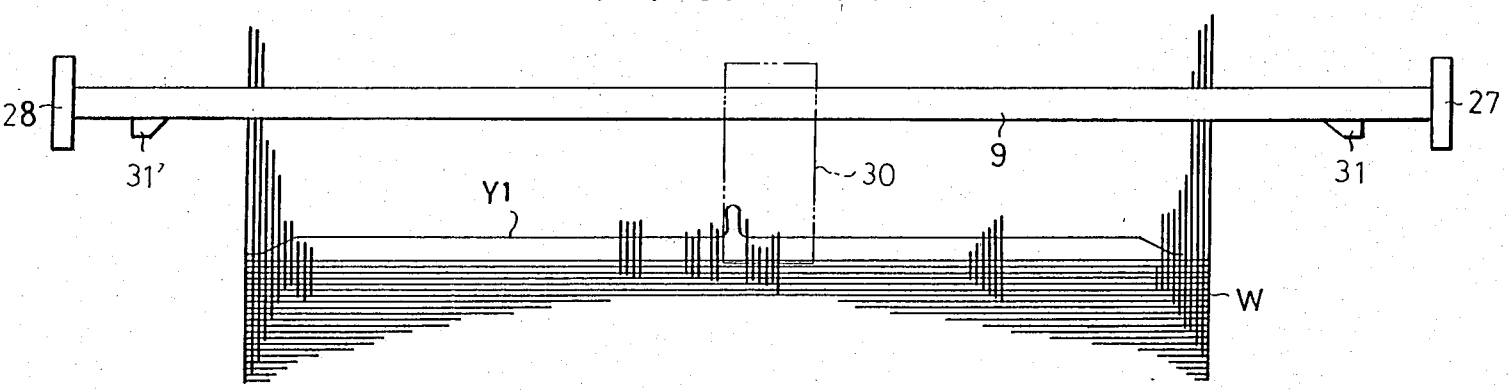

If the engaging projection 31′ is formed on the guide rail 29, the weft yarn treating device 30 reaches the engaging projection 31′ as illustrated in FIG. 13*d*, and the limit switch (not shown) as actuated by the engaging projection 31′. Thus, the reversible drive motor 37 is moved backwardly.

If the engaging projection 31′ is not formed on the guide rail 29, the reversible drive motor 37 is moved backwardly after the weft yarn separating operation is completed at the position corresponding to the magnet M4.

Figure 8:
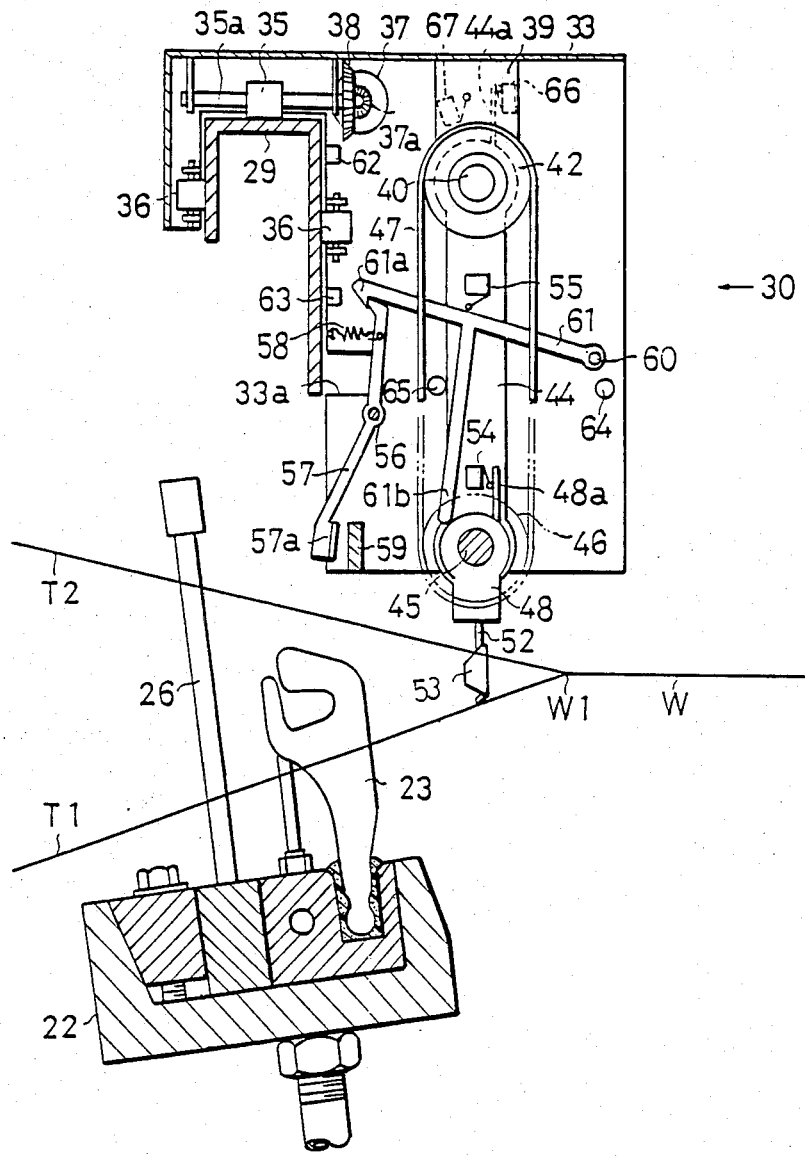
FIG. 8 is a sectional side view of the weft yarn treating device which has been operated from the condition shown in FIG. 6.

Thus, the weft yarn treating device 30 is moved toward the standby position A. When proximity switch 63 faces the magnet M, the reversible drive motor 37 is stopped and the reversible motor 43 is moved forwardly so as to perform the weft yarn separating operation which has been described above with reference to FIGS. 3 through 8. At this time, since the limit switch 66 is deenergized, the reversible motor 43 is not stopped by the limit switch 66. The further swinging motion of the swing arm 44 is prevented when the swing arm 44 abuts on the limiting rod 65 as illustrated in FIG. 8, and the force for rotating the lower shaft 45 by the reversible motor 43 exceeds the frictional torque between the swing arm 44 and the weft yarn separating arm 48.

Figure 10:
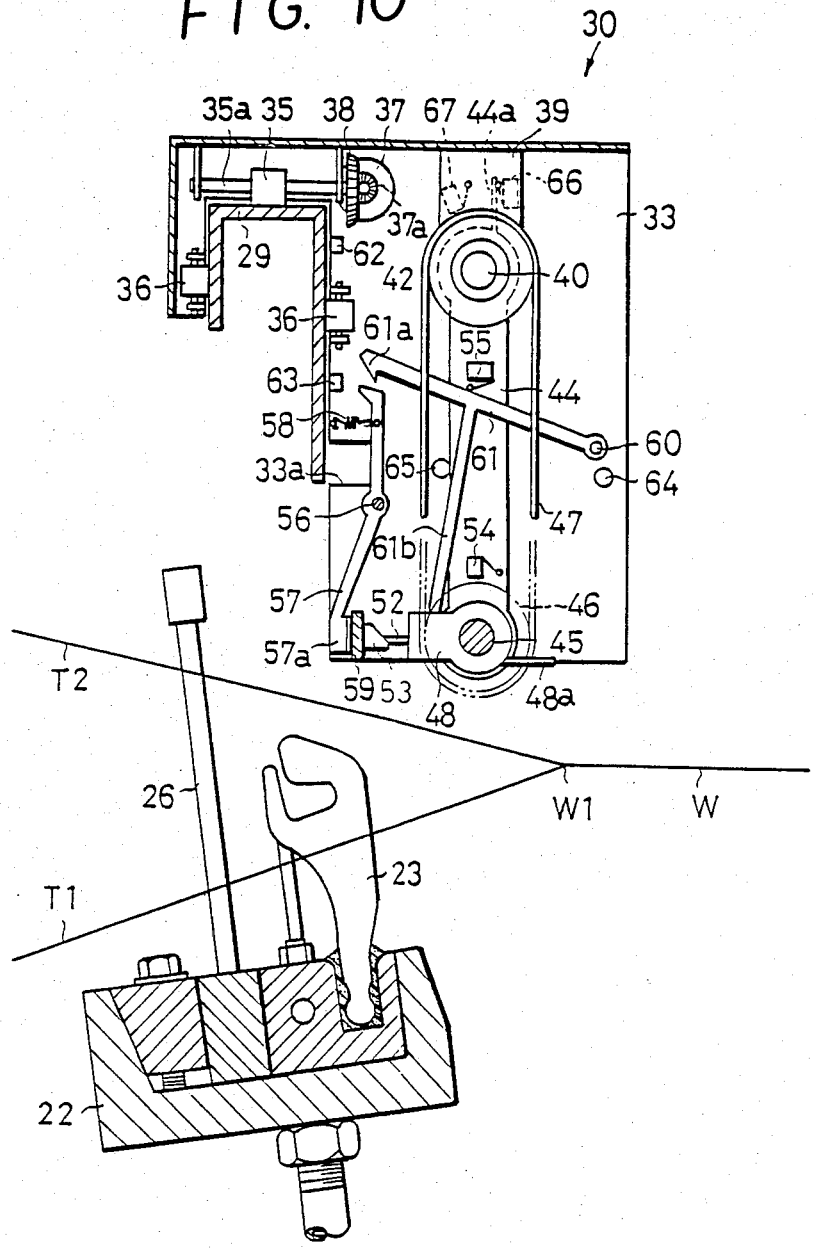
FIG. 10 is a sectional side view of the weft yarn treating device which has been operated from the condition shown in FIG. 8.
Figure 12:
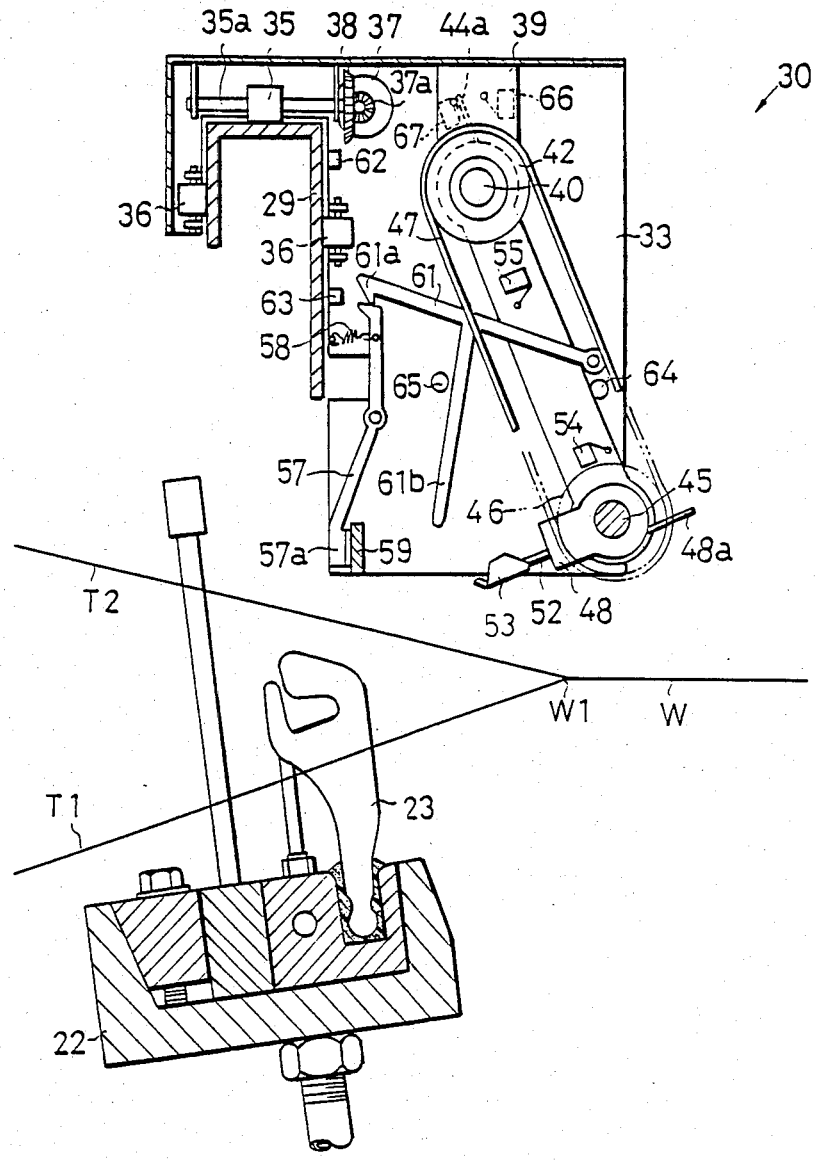
FIG. 12 is a sectional side view of the weft yarn treating device which has been operated from the condition shown in FIG. 10.

Accordingly, the lower shaft 45 is rotated relative to the swing arm 44. As a result, the weft yarn separating arm 48 is swung in a clockwise direction about the lower shaft 45 from the position illustrated in FIG. 8 to that in FIG. 9, while the weft yarn separating member 53 holds the faulty picked weft yarn Y'. Thus, the weft yarn separating member 53 is moved from the inside of the open shed to the outside of the open shed as illustrated in FIGS. 10 and 11, and a part of the faulty weft yarn Y' is withdrawn to the outside of the open shed (see FIG. 13*e*).

The weft yarn separating member 53 is swung to a position beside the holding member 57*a* of the weft yarn holding lever 57 and the stop member 59, and a part of faulty weft yarn Y', which has been withdrawn from the inside of the open shed, is positioned between the holding member 57*a* and the stop member 59. At the same time, as illustrated in FIG. 10, the weft yarn separating arm 48 abuts on the hanging portion 61*b* of the engaging lever 61. Accordingly, the engaging lever 61 is lifted until the hook portion disengages from the upper portion of the weft yarn holding lever 57. As a result, the weft yarn holding lever 57 is swung in a counter-clockwise direction about the support shaft 56 by means of the tension spring 58, and the holding member 57*a* and stop member 59 engage with each other so that the part of the faulty weft yarn Y', which has been withdrawn to the outside of the open shed, is securely held between the holding member 57*a* and stop member 59. In addition, the limit switch 55 is actuated by the engaging lever 61 which is lifted, and the reversible motor 43 is moved backwardly.

As the reversible motor 43 is rotated backwardly, the weft yarn separating arm 48 and swing arm 44 are rotated in unison about the swing shaft 40 while the weft yarn separating arm 48 remains outside the open shed. In this case, the engaging lever 61 is prevented from being dropped even when the hanging portion 61*b* of the engaging lever 61 and the weft upon yarn separating arm 48 are disengaged from each other, since the hook portion 61*a* is engaging the front portion of the weft yarn holding lever 57.

Figure 13F:
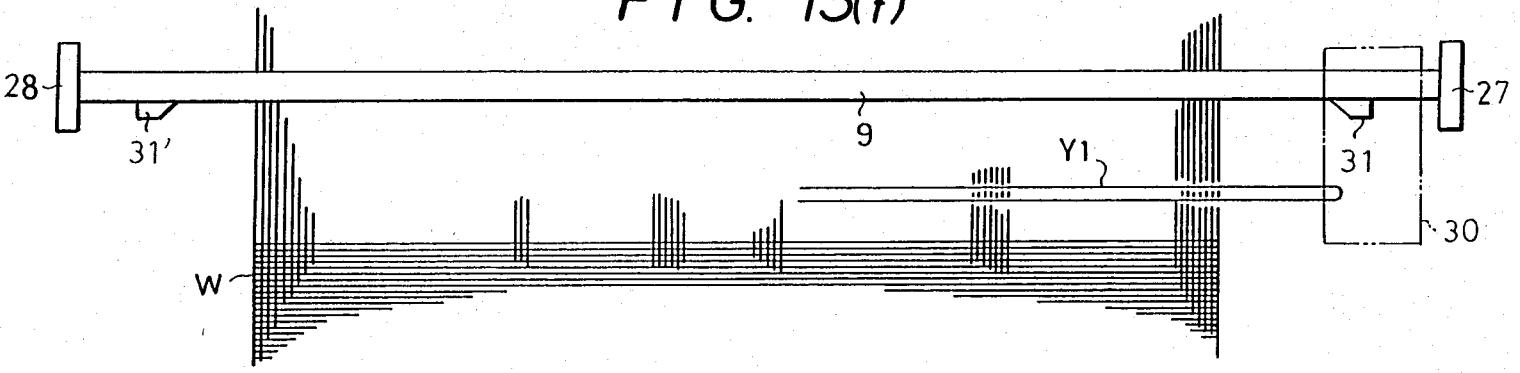

When the swing arm 44 abuts on the limiting rod 64 and its swinging motion is stopped, weft yarn separating arm 48 is rotated about the lower shaft 45 relative to the swing arm 44. As the dog 48*a* actuates the limit switch 54, and thereby the reversible drive motor 37 is rotated backwardly, the weft yarn treating device 30 is moved toward the standby position A along the guide rail 29. In this case, since the center of the faulty weft yarn Y' is firmly held by the weft yarn treating device 30, the faulty weft yarn Y' is withdrawn from the inside of the open shed to the outside of the open shed as the weft yarn treating device 30 is moved toward the standby position A. When the weft yarn treating device 30 reaches the standby position A, almost all the faulty weft yarn Y' is withdrawn to the outside of the open shed as illustrated in FIG. 13*f*.

When the weft yarn treating device 30 reaches the standby position A, the weft yarn holding lever 57 is engaged with the engaging projection 31, and the holding member 57*a* is disengaged from the stop member 59. Thus, the faulty weft yarn Y' is released from the holding member 57' and the stop member 59, and at the same time, the suction pipe 32 is operated to such the released faulty yarn Y'.

After the weft yarn treating device 30 is returned to the standby position A and the faulty weft yarn Y' is removed by being sucked by the suction pipe 32, the weaving loom is automatically operated in a reverse direction for a predetermined angle until it reaches a crank angle appropriate to restart. Thereafter, the weaving loom is restarted.

As described above, in this embodiment, weft yarn treating device 30, which is normally located at the standby position A during the normal operation of the weaving loom, is reciprocated along the guide rail 20 upon occurrence of a picking fault, and in the reciprocating movement of the weft yarn treating device 30, the weft yarn treating device 30 is stopped at a plurality of predetermined positions to separate the faulty weft yarn Y' from the woven fabric W. Then, at the last position, a part of the faulty weft yarn Y' is withdrawn from the inside of the open shed to the outside of the open shed, and the faulty weft yarn Y' is fully removed from the woven fabric as the weft yarn treating device 30 is returned to the standby position while the faulty weft yarn Y' is held by the weft yarn treating device 30. Consequently, troublesome operation can be avoided, which operation is inherent in the conventional manual methods for removing the faulty weft yarn, and the faulty weft yarn can be treated automatically.

Thus, the weft yarn treating device of the present invention can meet with the recent requirements for improving the automation of the weaving looms. Further, the period of suspension of a high speed weaving loom, which aims to enhance high productivity, can be minimized. Thus, the present invention can also meet with the requirements for speeding up the weaving looms.

Since only weft yarn separating member 53 is inserted into the inside of the open shed during the above-described weft yarn treating operation, the incidence of warp damage can be remarkably lower compared to the conventional weft treating device described in the paragraph entitled from art. Especially, a weft yarn holding member, i.e., the supporting surface 6 and the clamping surface 7 in the above-mentioned conventional device, which may easily catch the warp yarns, does not reciprocate between the outside of the open shed and the inside of the open shed, and therefore, there is no danger that warp yarns may be cut by the holding member.

In the present invention, the weft yarn holding member, comprising the holding member 57*a* of the weft yarn holding lever 57 and stop member 59, always remains outside of the open shed to receive a faulty weft yarn Y' from the weft yarn separating member 53. Accordingly, the space for required the weft yarn holding member is not limited as compared to the conventional device by which the weft yarn is transferred from the weft yarn separating member within th open shed and is held. Further, the timing for transferring the weft yarn can be easily set according to the present invention.

The above-described advantages of the present invention are achieved by utilizing a weft yarn separating means, which inserts the weft yarn separating member 53 from the outside of the open shed to the inside of the open shed, and a weft yarn withdrawing means which moves the weft yarn separating member 53 from the inside of the open shed to the outside of the open shed so as to withdraw a part of the weft yarn to the outside of the open shed. In other words, the weft yarn separating member acts differently upon separation of the weft yarn and upon withdrawal of the weft yarn. In the above-described embodiment, the swinging motion of the swing arm 44 under the conditions illustrated in FIGS. 3 through 8 serves to separate the weft yarn, and the swinging operation of the weft yarn separating arm 48 under the conditions illustrated in FIGS. 8 through 10 serves to withdraw of the weft yarn. It would be very difficult to separate a weft yarn from the woven fabric and withdraw it to the outside of the open shed, if these two kinds of operation are not utilized. For example, only the weft yarn separating member 53 is swung to separate a weft yarn from the woven fabric and to withdraw it to the outside of the open shed.

The present invention is not limited to the embodiment which has been explained above, and many alterations are possible. For example, the swing arm 44 may be fixed to the swing shaft 40 so as to directly swing the swing arm 44, and a rotary solenoid may be used in place of the timing pulleys 42 and 46 and timing belt 47 to swing the weft yarn separating arm 48 relative to the swing arm 44.

In another embodiment, the weft yarn separating member 53 may be vertically moved by means of a linear actuator so as to move the weft yarn separating member 53 from the inside of the open shed to the outside of the open shed.

Figure 14:
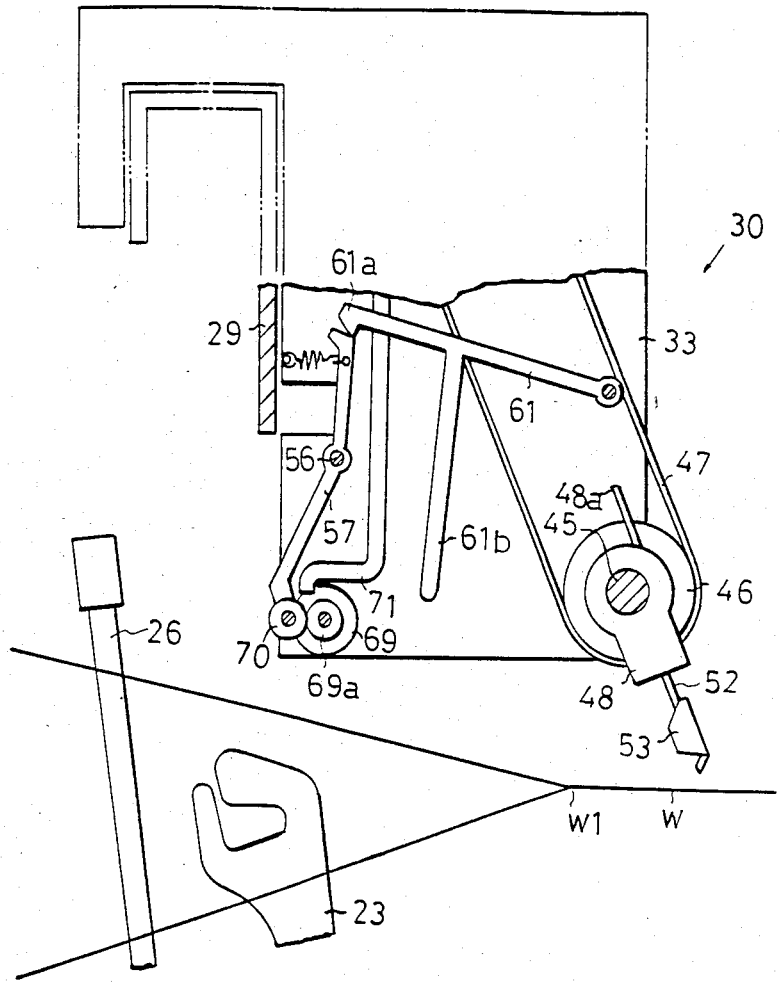
FIG. 14 is a side view of another embodiment of the device of the present invention.

In a further embodiment, as illustrated in FIG. 14, a pair of rollers 69 and 70, which can be urged against each other and can be separated from each other, may be utilized as a weft yarn holding means. After a faulty weft yarn is held between the rollers 69 and 70, the rollers 69 and 70 are rotated to remove the faulty weft yarn.

Furthermore, the suction pipe 71 may be disposed on the weft yarn treating device 30.

Another embodiment of the method according to the present invention will now be explained with reference to FIGS. 15 and 16*a* through 16*d*.

In this method, the inserting and separating operation takes place at at least one position in a first range between the standby position and a middle position within the width of the woven fabric. Thus, substantially the entire weft yarn within the first range is separated from the woven fabric. Then, the weft yarn separating member is moved, at the middle position, from the inside of the open shed to the outside of the open shed, while a part of the separated weft yarn is engaged with the weft yarn separating member. The separated weft yarn is withdrawn to the outside of the open shed. The withdrawn weft yarn is loosely held by a weft yarn holding means, which is mounted on the weft yarn treating device, at the outside of the open shed. Thereafter, the weft yarn treating device is moved toward a position opposite to the standby position, and the separated weft yarn is withdrawn from the inside of the open shed to the outside of the open shed.

The inserting and separating operation also takes place at at least one position in a second range between the position opposite to the standby position and the middle position of the width of the woven fabric. Thus, substantially the entire weft yarn is separated in the second range from the woven fabric. The weft yarn separating member is again moved, at the middle position, from the inside of the open shed to the outside of the open shed, while a part of the separated weft yarn is engaged with the weft yarn separating member so as to withdraw the separated weft yarn to the outside of the open shed. The thus withdrawn weft yarn is held by a weft yarn holding means, which is mounted on the weft yarn treating device, at the outside of the open shed. Thereafter, the weft yarn treating device is returned to the standby position, and the separated weft yarn is entirely removed from the inside of the open shed to the outside of the open shed.

Figure 15:
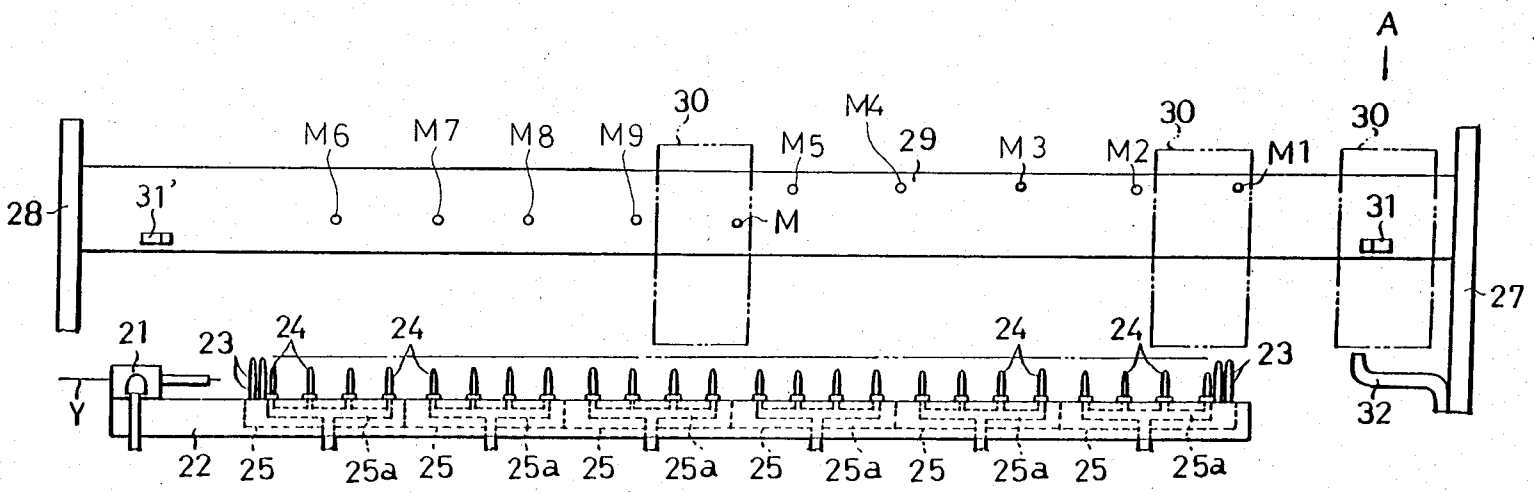
FIG. 15 is a schematic elevation view of a slay and a guide rail of another embodiment of the device according to the present invention.

As illustrated in FIG. 15, in the shuttleless weaving loom for performing the present method, five magnets M1 through M5 are disposed at the upper portion of the guide rail, and another five magnets M6 through M9 and M are disposed at the lower portion of the guide rail. The weft treating device 30 of this embodiment has a count circuit (not shown) mounted therein which serves to deenergize the limit switch 66 (FIG. 3) at every five signals from the proximity switches 62 and 63 (FIG. 3). Then, the reversible drive motor 43 is not operated even if the limit switches 66 and 67 are actuated.

The faulty weft yarn Y1 is separated from the woven fabric W by means of the weft yarn separating member 53 in a manner similar to that explained with reference to FIGS. 1 through 12 and FIGS. 13*a* through 13*c*.

Since the limit switch 62 is deenergized as described above when the weft yarn treating device reaches a position corresponding to the magnet M5, i.e., substantially the center of the woven fabric, the weft yarn separating member 53 is moved from the inside of the open shed to the outside of the open shed in a manner similar to that explained with reference to FIGS. 8 through 10, 12 and 13*e*. Together with the movement of the weft yarn separating member 53 to the outside of the open shed, the faulty weft yarn Y1 is withdrawn and held by the holding means. In this case, the holding means, comprising a holding member 57*a* and a stop member 59, loosely holds the withdrawn weft yarn Y1. In other words, a small gap is formed between the holding member 57*a* and the stop member 59 and the weft yarn is wrapped about the weft yarn separating member 53 to be frictionally engaged with the latter.

Then, the weft treating device 30 is moved to the side opposite to the standby position A. During the movement of the weft treating device 30, the faulty weft yarn Y1 located between the standby position and the center of the woven fabric, which has been separated from the woven fabric, moves around the weft yarn separating member 53 and is withdrawn from the open shed to the outside of the open shed in a direction substantially parallel to the weft yarn (see FIG. 16*a*). In the above-described withdrawal direction, the abrasion of the weft yarn with the warps can be minimized, and damage of the warps can also be minimized.

When the weft yarn treating device 30 reaches a position corresponding to the engaging projection 31', the weft yarn holding lever 57 is engaged with the engaging projection 31', and the holding member 57*a* is disengaged from the stop member 59. Thus, the faulty weft yarn Y1 is released from the weft yarn separating member 53. Further, the hook portion 61*a* of the engaging lever 61 is engaged with the upper portion of the weft yarn holding lever 57, and the upper portion of the engaging lever 61 abuts on the limit switch 55 and the swing arm 44 is swung backwardly. In addition, the engaging projection 31' actuates the reversible drive motor 37 in a reverse direction.

Thus, the weft yarn treating device 30 is moved from the position opposite to the standby position A toward the standby position. At positions corresponding to magnets M6, M7, M8 and M9, the weft yarn separating operation is performed in a manner similar to that effected at the magnets M1 through M4 (see FIGS. 16*b* and 16*c*).

Figure 16A:
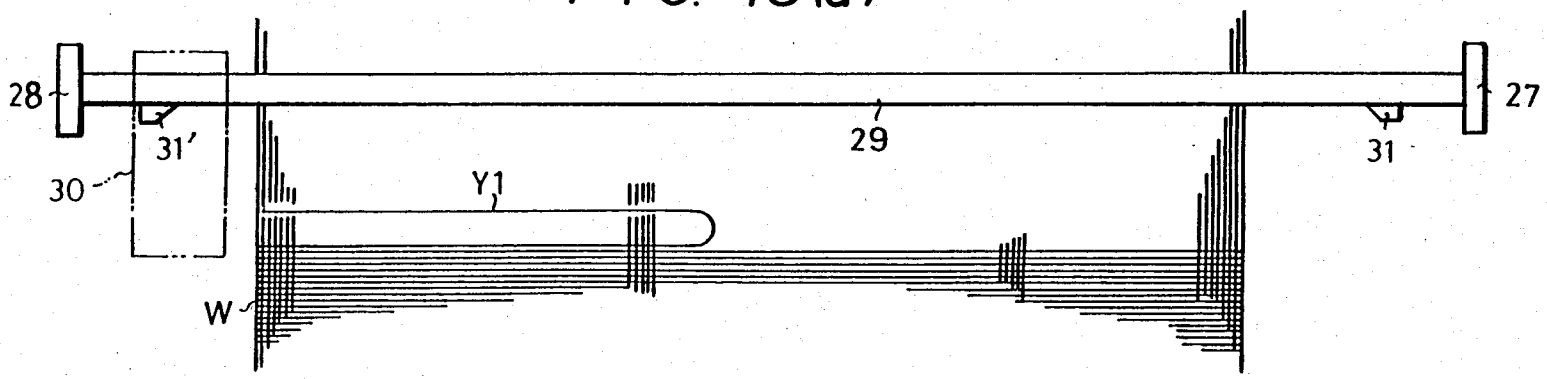
FIGS. 16*a* through 16*d* are plan views illustrating a second method for treating a weft yarn in accordance with the present invention.
Figure 16B:
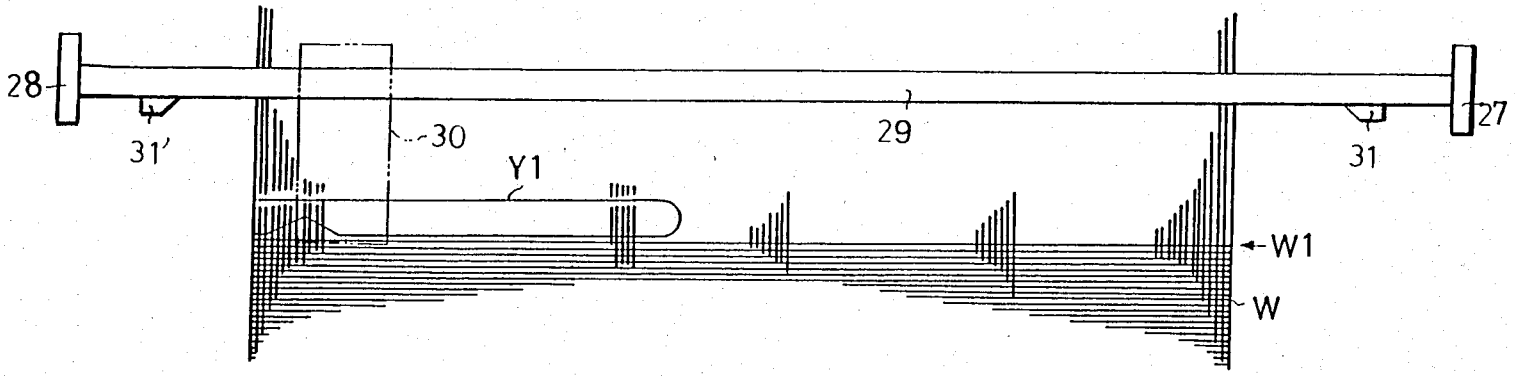
Figure 16C:
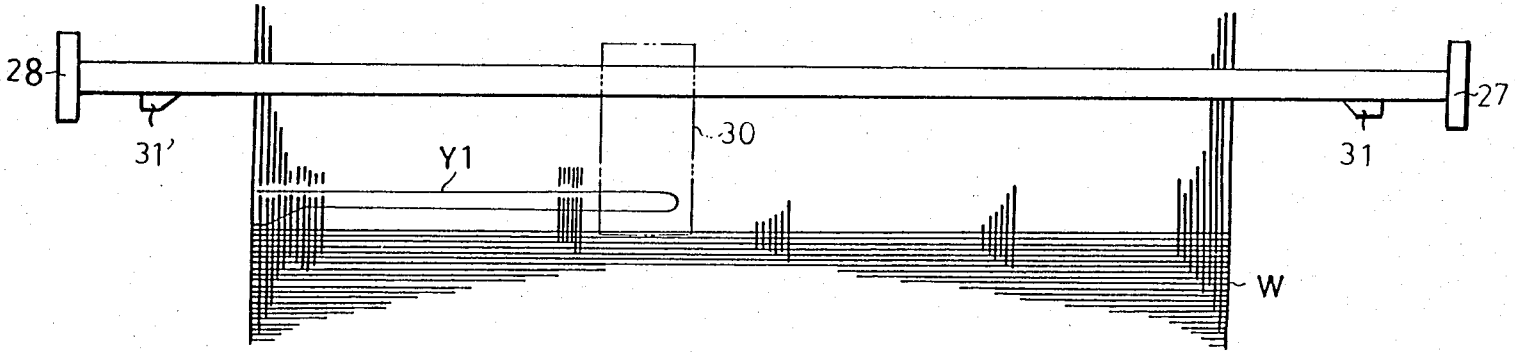
Figure 16D:
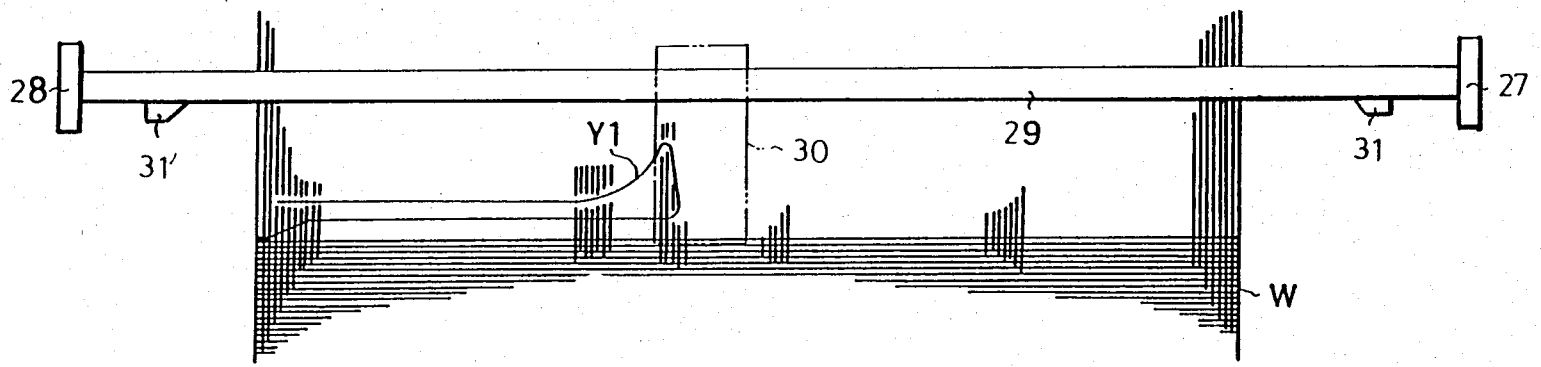

At a position corresponding to the magnet M, the weft yarn separating operation is substantially unnecessary, because the faulty weft yarn Y1 has been almost separated from the cloth fell, and the weft yarn separating member 53 is moved from the inside of the open shed to the outside of the open shed in the foregoing manner (see FIG. 16*d*). Accordingly, the central portion of the faulty weft yarn Y1 is withdrawn to the outside of the open shed as illustrated in FIG. 16*d*.

At that time, the faulty picked weft yarn Y1 is securely held by the holding member 57*a* and stop member 59 in a manner described above. Under this condition, the weft yarn treating device 30 is moved to the standby position A in a manner similar to that illustrated in FIG. 13*f*. Almost all the faulty weft yarn is removed from the woven fabric in a direction wherein the abrasion of the weft yarn with the warps can be minimized, and damage of the warps can also be minimized, until the weft treating device reaches the standby position A.

This method is not limited to the above-described embodiment. For example, the positions where the faulty weft yarn Y1 is withdrawn by the weft separating member 53 may be displaced to the right or left as long as the following conditions are satisfied. The length of the withdrawn faulty weft yarn during the forward movement of the weft yarn treating device 30 is shorter than the remaining forward distance after the withdrawing operation is commenced in the forward direction, and the length of the withdrawn faulty weft yarn during the backward movement of the weft yarn treating device 30 is shorter than the remaining backward distance after the withdrawing operation is commenced in the backward direction.

According to the embodiment explained with reference to FIGS. 15 and 16*a* through 16*d*, the length of a faulty weft yarn withdrawn at one time can be short, and accordingly, problems wherein a weft yarn is broken during the withdrawing operation can be minimized. However, there may be a problem that the weft yarn Y1 withdrawn in the forward movement of the weft yarn treating device 30 abrades a certain warp yarn and damages the latter. To obviate such a problem, in the following embodiment, in the forward movement of the weft yarn treating device 30, the withdrawn faulty yarn is cut before the weft yarn treating device is moved to a position opposite to the standby position.

Figure 17:
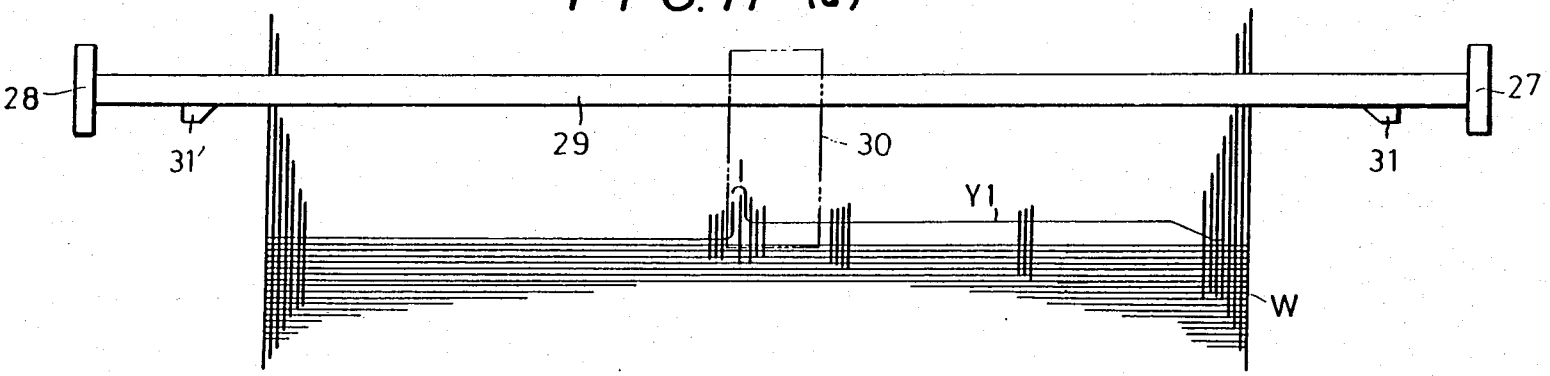
FIGS. 17*a* through 17*e* are plan views illustrating a third method for treating a weft yarn in accordance with the present invention.
Figure 17B:
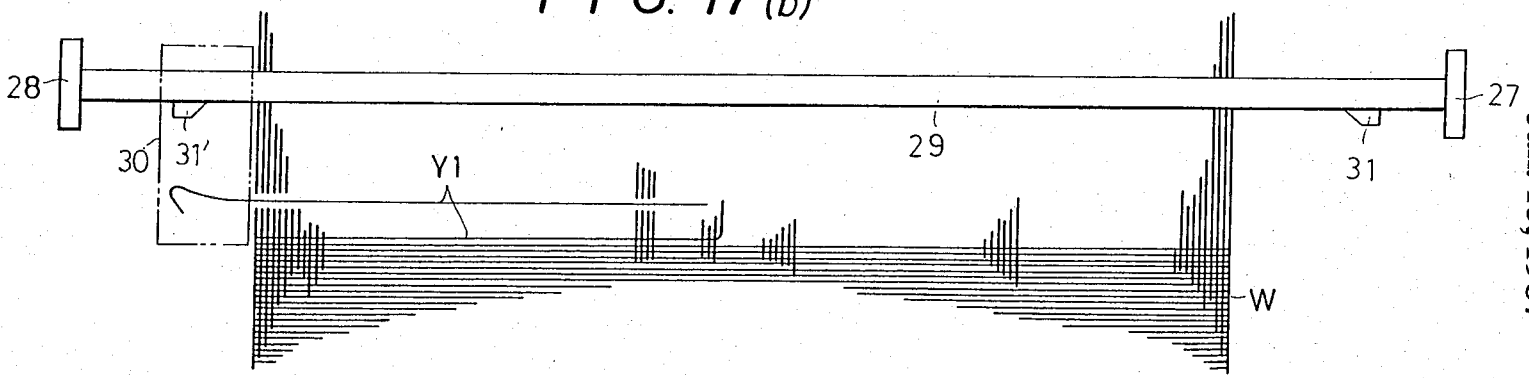
Figure 17C:
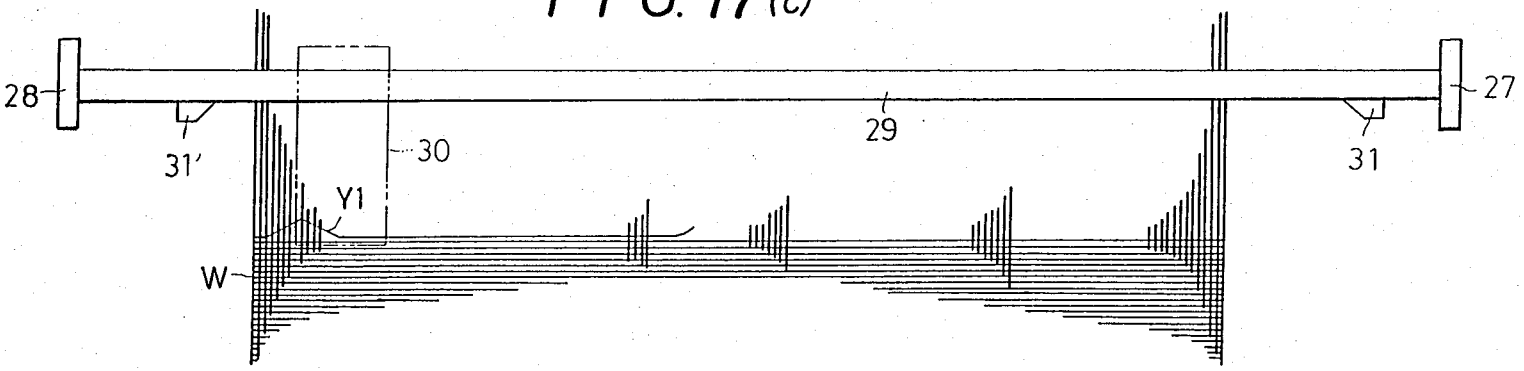
Figure 17D:
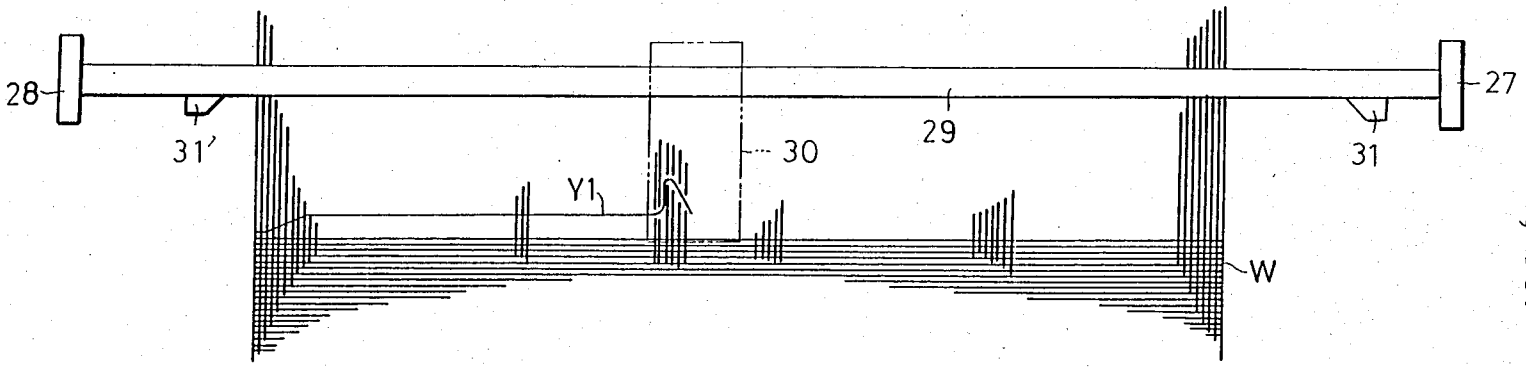
Figure 17E:
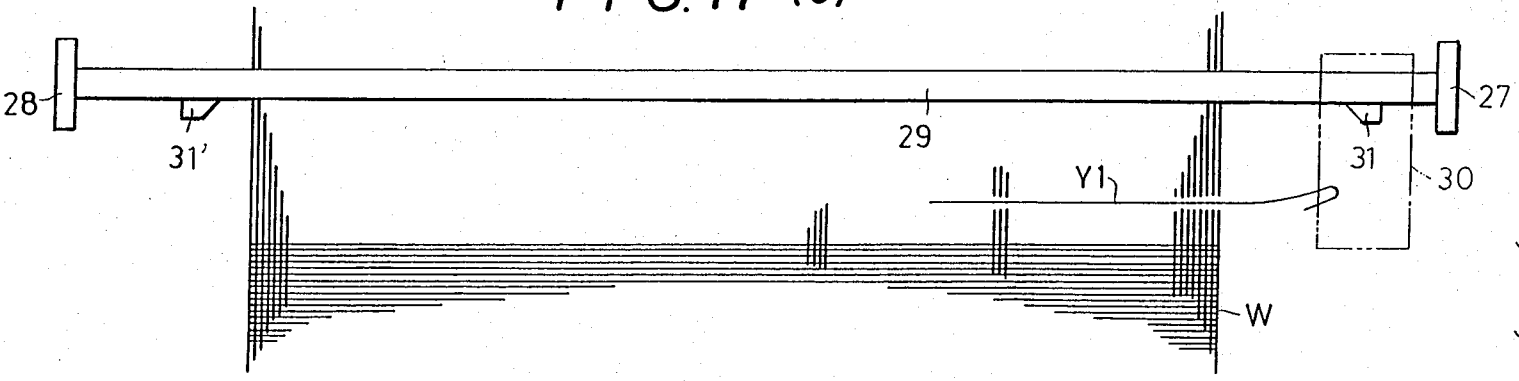
Figure 18:
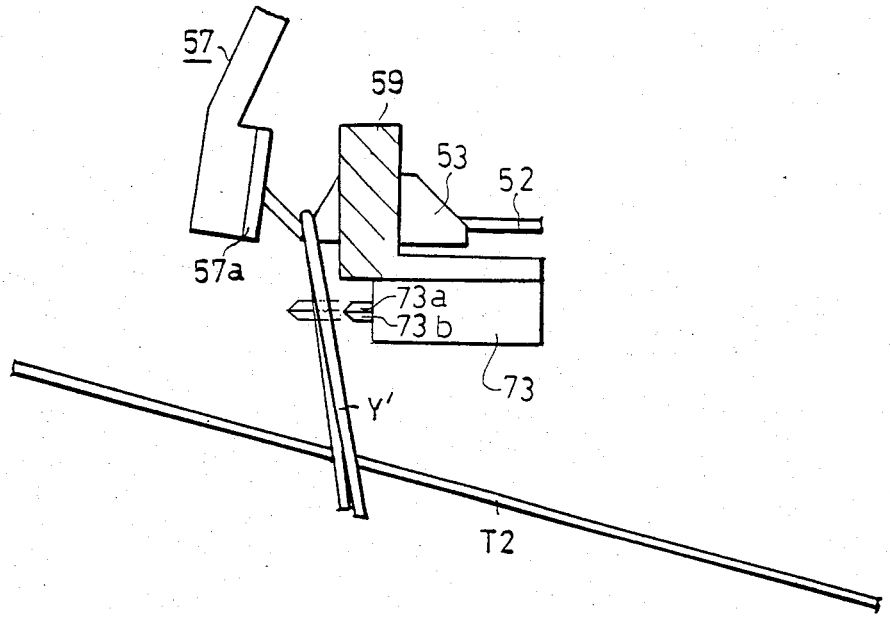
FIG. 18 is a sectional side view corresponding to FIG. 11.
Figure 19:
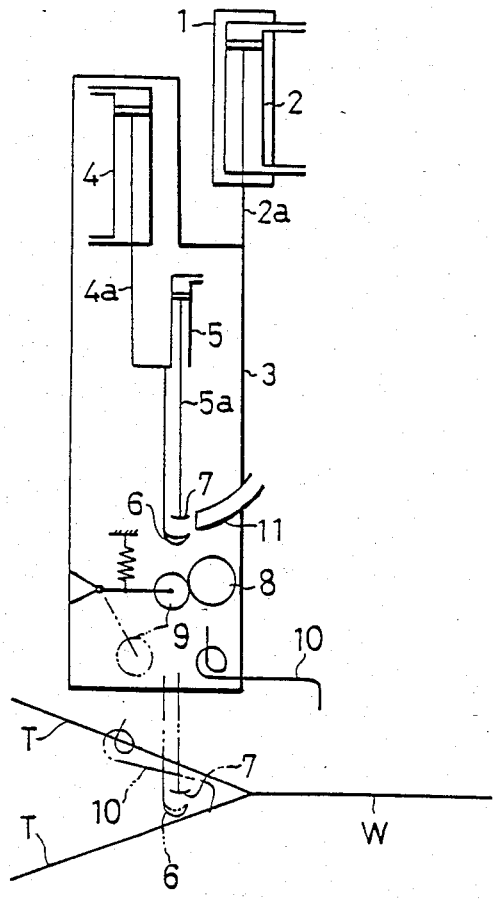
FIG. 19 PRIOR ART
FIG. 19 is a schematic side view illustrating a conventional device.

The weft yarn treating device 30 for performing this method is almost the same as that explained with reference to FIGS. 1 through 12, except that a yarn cutting mechanism is disposed thereon. In FIGS. 2 and 3, the mechanism for cutting a withdrawn weft yarn is disposed beneath the stop member 59 and comprises a pair of blades 73*a* and 73*b* (see FIG. 18) which are projected by an electromagnetic solenoid 73. The electromagnetic solenoid 73 is energized by means of the limit switch 55 during the withdrawing operation. Limit switch 72 illustrated in FIG. 2 is actuated by the engaging projection 31' to detect that the weft treating device 30 reaches the position corresponding to the engaging projection 31'. The operations of this method are very similar to those explained referring to FIGS. 16*a* through 16*d*. As clearly illustrated in FIGS. 17*a* and 18, the faulty yarn Y1 is cut at substantially the center of the woven fabric by means of the weft cutting mechanism 73*a* and 73*b*. The cutting operation is performed after the faulty weft yarn Y1 is withdrawn by the weft yarn separating member 53 from the inside of the open shed to the outside of the open shed and is securely held by the weft yarn holding means. The holding means comprises the holding member 57*a* and the stop member 59 as illustrated in FIGS. 2 and 3. The weft yarn Y1 is cut between that portion, of the weft yarn which is firmly held, and the remaining weft yarn which has not been separated from the woven fabric W. Then, the faulty weft Y1 is removed from the open shed, as the weft yarn treating device 30 moves to the position opposite to the standby position as illustrated in FIG. 17*b*.

According to this method, faulty weft yarn can be smoothly withdrawn without causing hard abrasion with warps. Further, since a length of a faulty weft yarn withdrawn at one time can be short, problems wherein a weft yarn is broken during the withdrawing operation can be minimized.

In the above-described embodiment, a cutter of the scissors type is utilized. However, another type cutter may be used, for example, a cutter wherein a blade is fixed to the weft yarn holding lever 57 and is pressed against the stop member 59.

In the above explanation, the repair of the faulty weft yarn is exemplified. However, the present invention is also applicable to repair a broken warp yarn or selvage, or stoppage of the air jet loom due to manual operation.

As described above, according to the present invention, a faulty weft yarn, upon the stoppage of a shuttleless loom, can be readily and automatically removed from the woven fabric without any troublesome manual operations and without causing any damages to warp yarns.

What is claimed is:

1. A method for treating a weft yarn in a shuttleless loom which has been stopped by a stopping signal, which comprises:

returning said shuttleless loom to form an open shed so as to release a weft yarn, which has been woven in a fabric just before the stoppage of said shuttleless loom, from its condition crossed by the warp yarns;

moving a weft yarn treating device, which is normally located at a standby position located at one side of said loom, in a widthwise direction of said shuttleless loom, and stopping said weft yarn treating device at a predetermined position along the width of said woven fabric;

inserting a weft yarn separating member, which is mounted on said weft yarn treating device, into the inside of said open shed from the outside of said open shed, at said predetermined position by rotating said weft yarn separating member, and separating said weft yarn from said woven fabric;

repeating said moving, inserting and separating operations at a plurality of positions along the width of said woven fabric;

further rotating said weft yarn separating member, at a position where said moving, inserting and separating operations last took place, from the inside of said open shed to the outside of said open shed, while a part of said separated weft yarn is engaged with said weft yarn separating member so as to withdraw said separated weft yarn to the outside of said open shed;

holding said withdrawn weft yarn on said weft yarn separating member by a weft yarn holding means, which is mounted on said weft yarn treating device, at the outside of said open shed so as to firmly hold said withdrawn weft yarn; and removing the remaining part of said weft yarn, which continues to be connected to said part of said separated weft yarn, from the inside of said open shed, by moving said weft yarn treating device in a widthwise direction of said shuttleless loom.

2. A method for treating a weft yarn in a shuttleless loom, which has been stopped by a stopping signal, which comprises:

returning said shuttleless loom to form an open shed so as to release a weft yarn, which has been woven in a fabric just before the stoppage of said shuttleless loom, from its condition crossed by the warp yarns;

moving a weft yarn treating device, which is normally located at a standby position located at one side of said loom, in a widthwise direction of said shuttleless loom, and stopping said weft yarn treating device at a predetermined position along the width of said woven fabric;

inserting a weft yarn separating member, which is mounted on said weft yarn treating device, into the inside of said open shed from the outside of said open shed, at said predetermined position, and separating said weft yarn from said woven fabric;

repeating said moving, inserting and separating operations at a plurality of positions along the width of said woven fabric;

moving said weft yarn separating member, after repetition of said moving, inserting and separating operations, from the inside of said open shed to the outside of said open shed, while a part of said separated weft yarn is engaged with said weft yarn separating member so as to withdraw said separated weft yarn to the outside of said open shed;

holding said withdrawn weft yarn by a weft yarn holding means, which is mounted on said weft yarn treating device, at the outside of said open shed; and removing the remaining part of said weft yarn, which continues to be connected to said part of said separated weft yarn, from the inside of said open shed, by a weft yarn removing means, and wherein:

said inserting and separating operation takes place at at least one position in a first range between said standby position and a middle position along the width of said woven fabric, so as to separate substantially all of the weft yarn in said first range from said woven fabric;

said weft yarn separting member is moved, at said middle position, from the inside of said open shed to the outside of said open shed, while a part of said separated weft yarn is engaged with said weft yarn separating member so as to withdraw said separated weft yarn to the outside of said open shed;

said withdrawn weft yarn is loosely held by a weft yarn holding means, which is mounted on said weft yarn treating device, at the outside of said open shed;

said weft yarn treating device is moved toward a position opposite to said standby position, and thereby withdraws said separated weft yarn from the inside of said open shed to the outside of said open shed;

said inserting said separating operation takes place at at least one position in a second range between said position opposite to said standby position and said middle position along the width of said woven fabric, so as to separate substantially all of the weft yarn in said second range from said woven fabric;

said weft yarn separating member is moved, at said middle position, from the inside of said open shed to the outside of said open shed, while a part of said separated weft yarn is engaged with said weft yarn separating member so as to withdraw said separated weft yarn to the outside of said open shed;

said withdrawn weft yarn is held by a weft yarn holding means, which is mounted on said weft yarn treating device, at the outside of said open shed; and said weft yarn treating device is moved toward said standby position, and said separated weft yarn is thereby entirely removed from the inside of said open shed to the outside of said open shed.

3. A method for treating a weft yarn in a shuttleless loom which has been stopped by a stopping signal, which comprises:

returning said shuttleless loom to form an open shed so as to release a weft yarn, which has been woven in a fabric just before the stoppage of said shuttleless loom, from its condition crossed by the warp yarns;

moving a weft yarn treating device, which is normally located at a standby position located at one side of said loom, in a widthwise direction of said shuttleless loom, and stopping said weft yarn treating device at a predetermined position along the width of said woven fabric;

inserting a weft yarn separating member, which is mounted on said weft yarn treating device, into the inside of said open shed fron the outside of said open shed, at said predetermined position, and separating said weft yarn from said woven fabric;

repeating said moving, inserting and separating operations at a plurality of positions along the width of said woven fabric;

moving said weft yarn separating member, after repetition of said moving, inserting and separating operations, from the inside of said open to the outside of said open shed, while a part of said separate weft yarn is engaged with said weft yarn separating member so as to withdraw said separated weft yarn to the outside of said open shed;

holding said withdrawn weft yarn by a weft yarn holding means, which is mounted on said weft yarn treating device, at the outside of said open shed; and removing the remaining part of said weft yarn, which continues to be connected to said part of said separated weft yarn, from the inside of said open shed, by a weft yarn removing means, and wherein:

said inserting and separating operation takes place at at least one position in a first range between said standby position and a middle position along the width of said woven fabric, so as to separate substantially all of the weft yarn in said first range from said woven fabric;

said weft yarn separating member is moved, at said middle position, from the inside of said open shed to the outside of said open shed, while a part of said separated weft yarn is engaged with said weft yarn separating member so as to withdraw said separated weft yarn to the outside of said open shed;

a part of said withdrawn weft yarn is firmly held by a weft yarn holding means, which is mounted on said weft yarn treating device, at the outside of said open shed;

said withdrawn weft yarn is cut by a weft yarn cutting mechanism mounted on said weft yarn treating device between the portion where said part of said weft yarn is firmly held, and the remaining portion of said weft yarn which has not been separated from said woven fabric;

said weft yarn treating device is moved toward a position opposite to said standby position, and thereby withdraws said separated weft yarn from the inside of said open shed to the outside of said open shed;

said inserting and separating operation takes place at at least one position in a second range between said position opposited to said standby position and said middle position along the width of said woven fabric, so as to separate substantially all of the weft yarn in said second range from said woven fabric;

said weft yarn separating member is moved, at said middle position, from the inside of said open shed to the outside of said open shed, while a part of said separated weft yarn is engaged with said weft yarn separating member so as to withdraw said separated weft yarn to the outside of said open shed;

said withdrawn weft yarn is firmly held by a weft yarn holding means, which is mounted on said weft yarn treating device, at the outside of said open shed; and said weft yarn treating device is moved toward said standby position, thereby removing all of said separated weft yarn from the inside of said open shed to the outside of said open shed.

4. A device for treating a weft yarn in a shuttleless loom, which comprises:

a weft yarn separating means rotatably mounted on an axis of said device for inserting a weft yarn separating member from the outside of an open shed into the inside of said open shed by rotating said weft yarn separating means so as to separate said weft yarn under said open shed condition wherein a weft yarn, which has been picked just before the stoppage of said shuttleless loom, is released from its condition crossed by the warp yarns;

a weft yarn withdrawing means including means rotatably mounting said weft yarn separating member on an axis of said weft yarn separating means for further rotating said weft yarn separating member from the inside of said open shed to the outside of said open shed so as to withdraw a part of said weft yarn to the outside of said open shed;

a weft yarn holding means for mechanically holding said part of said weft yarn on said weft yarn separating member, so as to hold said part of said weft yarn as it is withdrawn to the outside of said open shed; and a weft yarn removing means for removing the remaining weft yarn which continues to be connected to said part of said weft yarn.

5. A device for treating a weft yarn in a shuttleless loom which comprises:

a weft yarn separating means for inserting a weft yarn separating member from the outside of an open shed into the inside of said open shed so as to separate said weft yarn under said open shed condition wherein a weft yarn, which has been picked just before teh stoppage of said shuttleless loom, is released from its condition crossed by the warp yarns;

a weft yarn withdrawing means for moving said weft yarn separating member from the inside of said open shed to the outside of said open shed so as to withdraw a part of said weft yarn to the outside of said open shed;

a weft yarn holding means for holding said part of said weft yarn which has been withdrawn to the outside of said open shed; and a weft yarn removing means for further removing said remaining weft yarn which continues to be connected to said part of said weft yarn;

said weft yarn separating means and said weft yarn separating member comprising:

a drive motor mounted on said weft yarn treating device;

a swing shaft swung by said drive motor;

a swing arm hanging down from said swing shaft and swung about said swing shaft;

a lower shaft swingably supported by said lower end of said swing arm;

timing pulleys attached to said swing shaft and said lower shaft, respectively;

a loop timing belt engaging around said timing pulleys;

a weft yarn separating arm attached to a side of said timing pulley and swingable about said lower shaft;

a leaf spring connecting said weft yarn separating member to said weft yarn separating arm; and a brake lining attached to a side of said weft yarn separating arm and urged against said swing arm.

6. A device for treating a weft yarn in a shuttless loom which comprises:

a weft yarn separating means for inserting a weft yarn separating member from the outside of an open shed into the inside of said open shed so as to separate said weft yarn under said open shed condition wherein a weft yarn, which has been picked just before the stoppage of said shuttleless loom, is released from its condition crossed by the warp yarns;

a weft yarn withdrawing means for moving said weft yarn separating member from the inside of said open shed to the outside of said open shed so as to withdraw a part of said weft yarn to the outside of said open shed;

a weft yarn holding means for holding said part of said weft yarn which has been withdrawn to the outside of said open shed; and a weft yarn removing means for further removing said remaining weft yarn which continues to be connected to said part of said weft yarn, said weft yarn removing means comprising:

a guide rail for guiding said weft yarn treating device in a widthwise direction of said shuttleless loom;

a drive roller mounted on said weft yarn treating device so as to move said weft yarn treating device along said guide rail;

a drive motor for driving said drive roller; and said weft yarn holding means comprising a stop member and a holding member which can be pressed against said stop member.

7. A device for treating a weft yarn in a shuttleless loom which comprises:

a weft yarn separating means for inserting a weft yarn separating member from the outside of an open shed into the inside of said open shed so as to separate said weft yarn under said open shed condition wherein a weft yarn, which has been picked just before the stoppage of said shuttleless loom, is released from its condition crossed by the warp yarns;

a weft yarn withdrawing means for moving said weft yarn separating member from the inside of said open shed to the outside of said open shed so as to withdraw a part of said weft yarn to the outside of said open shed;

a weft yarn holding means for holding said part of said weft yarn which has been withdrawn to the outside of said open shed; and a weft yarn removing means for further removing said remaining weft yarn which continues to be connected to said part of said weft yarn, a weft yarn cutting mechanism being mounted on said weft yarn treating device.

* * * * *